US006630291B1

(12) United States Patent
Maskasky et al.

(10) Patent No.: US 6,630,291 B1
(45) Date of Patent: Oct. 7, 2003

(54) THERMALLY SENSITIVE IMAGING MATERIALS CONTAINING PHTHALAZINE PRECURSOR

(75) Inventors: Joe E. Maskasky, Rochester, NY (US); Victor P. Scaccia, Rochester, NY (US); David A. Dickinson, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/224,850

(22) Filed: Aug. 21, 2002

(51) Int. Cl.[7] ..... G03C 5/16
(52) U.S. Cl. ..... 430/350
(58) Field of Search ..... 430/619, 955, 430/965, 944, 350, 600, 620, 510, 611, 631

(56) References Cited

U.S. PATENT DOCUMENTS

| | | | | |
|---|---|---|---|---|
| 3,074,809 A | | 1/1963 | Owen | |
| 3,080,254 A | | 3/1963 | Grant, Jr. | |
| 3,446,648 A | | 5/1969 | Workman | |
| 3,782,941 A | | 1/1974 | Hartman et al. | |
| 3,844,797 A | | 10/1974 | Willems et al. | |
| 3,847,612 A | | 11/1974 | Winslow | |
| 3,951,660 A | | 4/1976 | Hagemann et al. | |
| 4,082,901 A | | 4/1978 | Laridon et al. | |
| 4,123,282 A | | 10/1978 | Winslow | |
| 4,260,677 A | | 4/1981 | Winslow et al. | |
| 4,510,236 A | | 4/1985 | Gutman | |
| 4,585,734 A | | 4/1986 | Weigel | |
| 5,599,647 A | | 2/1997 | Defieuw et al. | |
| 5,656,419 A | * | 8/1997 | Toya et al. | 430/619 |
| 5,756,650 A | * | 5/1998 | Kawamonzen et al. | 528/353 |
| 6,146,822 A | | 11/2000 | Asanuma et al. | |

FOREIGN PATENT DOCUMENTS

| | | |
|---|---|---|
| GB | 1 380 795 | 1/1975 |
| GB | 1 439 478 | 6/1976 |

* cited by examiner

*Primary Examiner*—Thorl Chea
(74) *Attorney, Agent, or Firm*—J. Lanny Tucker

(57) ABSTRACT

Aqueous-based thermally sensitive emulsions and photothermographic imaging materials include phthalazine N-oxide or a derivative thereof to improve raw stock keeping and to extend the useful range of processing temperatures without interfering with spectral sensitization. The emulsions and photothermographic materials may also include a cyclic imide, phthalazinone, benzoxazine dione, benzthiazine dione, or quinazoline dione as a development promoter.

27 Claims, No Drawings

THERMALLY SENSITIVE IMAGING MATERIALS CONTAINING PHTHALAZINE PRECURSOR

FIELD OF THE INVENTION

This invention relates to thermally developable imaging emulsions and materials. In particular, it relates to thermally sensitive emulsions and photo-thermographic materials that comprise a phthalazine N-oxide or a derivative thereof as a phthalazine precursor.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet, or infrared radiation) and developed by the use of thermal energy. These materials, also known as "dry silver" materials, generally comprise a support having coated thereon: (a) a photosensitive catalyst (such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photo-graphic type photosensitive silver halide that is considered to be in catalytic proximity to the non-photosensitive source of reducible silver ions. Catalytic proximity requires intimate physical association of these two components either prior to or during the thermal image development process so that when silver atoms, $(Ag^0)_n$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms [Klosterboer, *Imaging Processes and Materials* (Neblette's Eighth Edition), Sturge, Walworth & Shepp (Eds.), Van Nostrand-Reinhold, New York, Chapter 9, pp. 279–291, 1989]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide, have also been reported to be useful in place of silver halide as the photocatalyst in photothermographic materials [see for example, Shepard, *J Appl. Photog. Eng.* 1982, 8(5), 210–212, Shigeo et al., Nippon Kagaku Kaishi, 1994, 11, 992–997, and FR 2,254,047 (Robillard)].

The photosensitive silver halide may be made "in situ," for example, by mixing an organic or inorganic halide-containing source with a source of reducible silver ions to achieve partial metathesis and thus causing the in situ formation of silver halide (AgX) grains throughout the silver source [see, for example, U.S. Pat. No. 3,457,075 (Morgan et al.)]. In addition, photosensitive silver halides and sources of reducible silver ions can be co-precipitated [see Usanov et al., *J. Imag. Sci. Tech.* 40, 104 (1996)]. Alternatively, a portion of the reducible silver ions can be completely converted to silver halide, and that portion can be added back to the source of reducible silver ions (see Usanov et al., International Conference on Imaging Science, 7–11 September 1998).

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to, and be present during, the formation of the source of reducible silver ions. Co-precipitation of the silver halide and the source of reducible silver ions provides a more intimate mixture of the two materials [see for example, U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent for silver ion. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

The various distinctions between photothermographic and photographic materials are described in *Imaging Processes and Materials* (Neblette's Eighth Edition), noted above,

*Unconventional Imaging Processes*, E. Brinckman et al. (Eds.), The Focal Press, London and New York, 1978, pp. 74–75, in Zou et al., *J. Imaging Sci. Technol.* 1996, 40, 94–103, and in M. R. V. Sahyun, *J. Imaging Sci. Technol.* 1998, 42, 23.

Problem to be Solved

Most common photothermographic materials are prepared using organic solvents for layer formulation and coating, and therefore often identified as "solvent-based" or "non-aqueous" materials. The various chemical components required for such materials are generally soluble in the organic solvents and insoluble in water.

However, photothermographic materials that can be formulated and coated out of water ("aqueous-based" materials) would have a number of manufacturing, environmental, and cost advantages. Use of the same chemical components that are present in solvent-based materials is not always possible in aqueous environments without the use of expensive or tedious solubilizing or dispersing techniques. The water-insoluble chemical components tend to precipitate and cause variability in photosensitive response and coating defects when used in aqueous formulations even with adequate dispersion.

To improve the image density and color in photothermographic materials, it is common to include one or more compounds that are known as "toners" in the imaging layers. A variety of such compounds are known for this purpose including phthalimide, phthalazinones, and phthalazine as described for example in U.S. Pat. No. 4,123,282 (Winslow) and U.S. Pat. No. 4,585,734 (Weigel).

Phthalazine or derivatives thereof have become the most common toners in photothermographic materials as described for example in U.S. Pat. No. 6,413,710 (Shor et al.) and U.S. Pat. No. 6,146,822 (Asanuma et al.). We have tried to use phthalazine in aqueous-based photothermographic materials to increase $D_{max}$ in an attempt to reduce silver coverage and image "print-out" resulting from higher silver coverage. However, we have observed that raw stock keeping of the materials can be diminished if phthalazine is present therein as the predominant toner.

Hence, there is a need for improved aqueous-based (hydrophilic) thermally developable formulations and materials that exhibit desired raw stock keeping while reducing image "print-out".

SUMMARY OF THE INVENTION

The present invention provides a thermally sensitive emulsion comprising:

a) a photosensitive silver halide, b) a non-photosensitive source of reducible silver ions, c) a hydrophilic binder, d) a reducing agent composition for the reducible silver ions, e) a development promoter, and f) phthalazine N-oxide or a derivative thereof.

This invention also provides a photothermographic material comprising a support having thereon at least one imaging layer comprising a hydrophilic binder, and having in reactive association:

a) a photosensitive silver halide, b) a non-photosensitive source of reducible silver ions, c) a reducing agent composition for the reducible silver ions, d) a development promoter, and e) phthalazine N-oxide or a derivative thereof.

Particularly preferred embodiments of this invention include a photothermographic material comprising a transparent support having thereon an aqueous-based imaging layer comprising gelatin or a gelatin derivative as binder, an aqueous-based surface protective overcoat over the imaging layer, and an aqueous-based antihalation layer on the backside of the support, and the imaging layer having in reactive association:

a) photosensitive silver bromide, silver iodobromide, or both, b) a non-photosensitive source of reducible silver ions that comprises one or more silver carboxylates provided as an aqueous nanoparticulate dispersion, at least one of which silver carboxylates is silver behenate, c) a reducing agent composition for the reducible silver ions that includes 2,2'(2-methylpropylidene)bis(4,6-dimethyl-phenol), 2,2'-(3,5,5-trimethylhexylidene) bis(4,6-dimethyl-phenol), or a mixture thereof, d) one or more antifoggants or spectral sensitizing dyes, e) succinimide, 2H-1,3-benzoxazine-2,4-(3H)-dione, or phthalazinone as a development promoter, and f) phthalazine N-oxide present in an amount of from about 4 to about 800 mmole per mole of total silver.

Further, this invention provides a method of forming a visible image comprising:

A) imagewise exposing the photothermographic material of this invention to electromagnetic radiation at a wavelength greater than 400 nm to form a latent image, B) simultaneously or sequentially, heating the exposed photothermo-graphic material to develop the latent image into a visible image.

This method can be taken further wherein the photothermographic material comprises a transparent support, by comprising the steps of:

C) positioning the exposed and heat-developed photothermographic material having the visible image therein between a source of imaging radiation and an imageable material that is sensitive to the imaging radiation, and D) thereafter exposing the imageable material to the imaging radiation through the visible image in the exposed and heat-developed photothermographic material to provide a visible image in the imageable material.

The phthalazine N-oxide compounds useful in this invention have been found to provide improved image density, raw stock keeping, and development temperature latitude in aqueous-based photothermographic emulsions and materials. The mechanism for achieving these advantages is not fully understood. They may be "precursors" that may release phthalazine or a derivative thereof that can then act as a toner in the imaging emulsion environment. In some embodiments, the amount of total coated silver can be lowered with the present invention. In other embodiments, the practice of this invention provides flexibility in the particular development temperatures used to form the image. That is, the phthalazine N-oxide may provide improved heat developability in certain embodiments (for example, lower processing temperatures) and the amount of development promoter may be reduced also.

DETAILED DESCRIPTION OF THE INVENTION

The thermally developable emulsions and photothermographic materials of this invention can be used, for example, in conventional black-and-white or color photothermography, in electronically generated black-and-white or color hardcopy recording. They can be used in microfilm applications, in radiographic imaging (for example digital medical imaging), and industrial radiography. Furthermore, the absorbance of these photothermographic materials between 350 and 450 nm is sufficiently low (less than 0.5) to permit their use in graphic arts applications such as contact printing, proofing, and duplicating ("duping"). The photothermographic materials of the present invention are particularly useful for medical, dental, and veterinary radiography to obtain black-and-white images.

The photothermographic materials of this invention can be made sensitive to radiation of any suitable wavelength. Thus, in some embodiments, the materials are sensitive at ultraviolet, visible, infrared or near infrared wavelengths of the electromagnetic spectrum. In other embodiments they are sensitive to X-radiation.

The materials of this invention are also useful for non-medical uses of visible or X-radiation (such as X-ray lithography and industrial radiography).

In the photothermographic materials of this invention, the components for imaging can be in one or more layers. The layer(s) that contain a photosensitive silver halide or non-photosensitive source of reducible silver ions, or both, are referred to herein as emulsion layer(s). The photosensitive silver halide and the non-photosensitive source of reducible silver ions are in catalytic proximity (that is, in reactive association with each other) and preferably in the same emulsion layer.

Where the materials contain imaging layer(s) on one side of the support only, various non-imaging layers can be disposed on the "backside" (non-emulsion or non-imaging side) of the materials, including antihalation layer(s), protective layers, antistatic layers, conducting layers, and transport enabling layers.

In such instances, various non-imaging layers can also be disposed on the "frontside", imaging, or emulsion side of the support, including protective topcoat layers, primer layers, interlayers, opacifying layers, antistatic layers, antihalation layers, acutance layers, auxiliary layers, and others readily apparent to one skilled in the art.

In some applications it may be useful that the photothermographic materials be "double-sided" and have thermally developable coatings on both sides of the support. In such constructions each side can also include one or more protective topcoat layers, primer layers, interlayers, antistatic layers, acutance layers, auxiliary layers, anti-crossover layers, and other layers readily apparent to one skilled in the art.

When the photothermographic materials of this invention are heat-developed as described below in a substantially water-free condition after, or simultaneously with, imagewise exposure, a silver image (preferably a black-and-white silver image) is obtained.

Definitions

As used herein:

In the descriptions of the photothermographic materials of the present invention, "a" or "an" component refers to "at least one" of that component. Thus, the phthalazine N-oxide and derivatives thereof can be used individually or in mixtures.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Macmillan 1977, p. 374.

"Photothermographic material(s)" means a construction comprising at least one photothermographic emulsion layer or a photothermographic set of layers wherein the photosensitive silver halide and the non-photosensitive source of reducible silver ions are in one layer and the other components or additives are distributed, as desired, in an adjacent coating layer and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development.

The term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

"Catalytic proximity" or "reactive association" means that the materials are in the same layer or in adjacent layers so that they readily come into contact with each other during thermal imaging and development.

"Emulsion layer," "imaging layer," "photothermographic emulsion layer" means a layer of a photothermographic material that contains the photosensitive silver halide and/or non-photosensitive silver compounds. It can also mean a layer of the photothermographic material that contains, in addition to the photosensitive silver halide and/or non-photosensitive silver compounds, additional essential components and/or desirable additives. These layers are usually on what is known as the "frontside" of the support.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed," "speed," or "photographic speed" (also known as sensitivity), absorbance, contrast, $D_{min}$, and $D_{max}$ have conventional definitions known in the imaging arts. In photothermographic materials, $D_{min}$ is considered herein as image density achieved when the photo-thermographic material is thermally developed without prior exposure to radiation.

"Transparent" means capable of transmitting visible light or imaging radiation without appreciable scattering or absorption.

The terms "double-sided" and "double-faced coating" are used to define photothermographic materials having one or more of the same or different emulsion layers disposed on both sides (front and back) of the support.

In the compounds described herein, no particular double bond geometry (for example, cis or trans) is intended by the structures drawn. Similarly, the alternating single and double bonds and localized charges are drawn as a formalism. In reality, both electron and charge delocalization exists throughout the conjugated chain.

As is well understood in this art, for the chemical compounds (such as the toners) described herein, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$—and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire-PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred, with the latter silver halide generally having up to 10 mole % silver iodide. Silver bromide is most preferred. Typical techniques for preparing and precipitating silver halide grains are described in *Research Disclosure*, 1978, item 17643.

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions.

It is more preferable to form the source of reducible silver ions as a shell on the surface of ex-situ-prepared silver halide. In this process, the source of reducible silver ions, such as a long chain fatty acid silver carboxylate (commonly referred to as a silver "soap"), is formed by exchange of some of the halide ion of the preformed silver halide grains by an organic silver coordinating ligand. Formation of the reducible source of silver ions as a shell on the surface of the silver halide provides a more intimate mixture of the two materials. Materials of this type are often referred to herein as "preformed soaps."

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

It may also be effective to use an in-situ process in which a halide-containing compound is added to the organic silver salts of this invention to partially convert the silver of the organic silver salt to silver halide. The halogen-containing compound can be inorganic (such as zinc bromide or lithium bromide) or organic (such as N-bromosuccinimide).

Mixtures of both preformed and in-situ generated silver halide may also be used if desired.

In some instances, it may be helpful to prepare the photosensitive silver halide grains in the presence of a hydroxytetrazaindene (such as 4-hydroxy-6-methyl-1,3,3a, 7-tetrazaindene or an N-heterocyclic compound comprising at least one mercapto group (such as 1-phenyl-5-mercaptotetrazole) to provide increased photospeed. Details of this procedure are provided in U.S. Pat. No. 6,413,710 (Shor et al.), that is incorporated herein by reference.

The one or more light-sensitive silver halides used in the photo-thermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

In some embodiments of this invention, the total amount of silver (from both the silver halides and silver salts described below) is less than or equal to 5 $g/m^2$, and preferably less than or equal to 3 $g/m^2$. The minimum total amount of silver in such embodiments is generally at least 0.2 $g/m^2$.

Chemical and Spectral Sensitizers

The photosensitive silver halides used in the photothermographic emulsions and materials of the invention may be may be employed without modification. However, one or more conventional chemical sensitizers may be used in the preparation of the photosensitive silver halides to increase photospeed. Such compounds may contain sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP 0 915 371A1 (Lok et al.).

In addition, mercaptotetrazoles and tetraazindenes as described in U.S. Pat. No. 5,691,127 (Daubendiek et al.), incorporated herein by reference, can be used as suitable addenda for tabular silver halide grains.

When used, sulfur sensitization is usually performed by adding a sulfur sensitizer and stirring the emulsion at an appropriate temperature predetermined time. Examples of sulfur sensitizers include compounds such as thiosulfates, thioureas, thiazoles, rhodanines, thiosulfates and thioureas. In one preferred embodiment, chemical sensitization is achieved by oxidative decomposition of a sulfur-containing spectral sensitizing dye in the presence of a photothermographic emulsion. Such sensitization is described in U.S. Pat. No. 5,891,615 (Winslow et al.), incorporated herein by reference.

In another embodiment, certain substituted and unsubstituted thiourea compounds can be used as chemical sensitizers. Particularly useful tetra-substituted thioureas are described in U.S. Pat. No. 6,368,779 (Lynch et al.), that is incorporated herein by reference.

Other useful chemical sensitizers include certain tellurium-containing compounds that are described in copending and commonly assigned U.S. Ser. No. 09/975,909 (filed Oct. 11, 2001 by Lynch, Opatz, Shor, Simpson, Willett, and Gysling), that is incorporated herein by reference.

Combinations of gold (3+)-containing compounds and either sulfur- or tellurium-containing compounds are also useful as chemical sensitizers as described in U.S. Pat. No. 6,423,481 (Simpson et al.), that is also incorporated herein by reference.

Still other useful chemical sensitizers include certain selenium-containing compounds that are described in copending and commonly assigned U.S. Ser. No. 10/082,516 (filed Feb. 25, 2002 by Lynch, Opatz, Gysling, and Simpson), that is also incorporated herein by reference.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 $\mu$m. The upper limit can vary depending upon the compound(s) used, the level of silver halide and the average grain size, and would be readily determinable by one of ordinary skill in the art.

Spectral Sensitizers

The photosensitive silver halides may be spectrally sensitized with various spectral sensitizing dyes that are known to enhance silver halide sensitivity to ultraviolet, visible, and/or infrared radiation. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Cyanine dyes are particularly useful. The cyanine dyes preferably include benzothiazole, benzoxazole, and benzoselenazole dyes that include one or more thioalkyl, thioaryl, or thioether groups. Suitable visible sensitizing dyes such as those described in U.S. Pat. No. 3,719,495 (Lea), U.S. Pat. No. 4,439,520 (Kofron et al.), and U.S. Pat. No. 5,281,515 (Delprato et al.)

are effective in the practice of the invention. Suitable infrared sensitizing dyes such as those described in U.S. Pat. No. 5,393,654 (Burrows et al.), U.S. Pat. No. 5,441,866 (Miller et al.) and U.S. Pat. No. 5,541,054 (Miller et al.) are also effective in the practice of this invention. A summary of generally useful spectral sensitizing dyes is contained in *Research Disclosure*, item 308119, Section IV, December 1989. Additional classes of dyes useful for spectral sensitization, including sensitization at other wavelengths are described in *Research Disclosure*, 1994, item 36544, section V. All of the references and patents above are incorporated herein by reference.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Reducible Silver Source Material

The non-photosensitive source of reducible silver ions used in the photothermographic materials of the present invention can be any material that contains reducible silver ions. Preferably, it is a silver salt that is comparatively stable to light and forms a silver image when heated to 80° C. or higher in the presence of an exposed photosensitive silver halide and/or a reducing agent.

Silver salts of organic acids, particularly silver salts of long-chain carboxylic (fatty) acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. It is particularly useful to have at least silver behenate included as one of the silver carboxylates.

Preferred examples of the silver salts of aromatic carboxylic acid and other carboxylic acid group-containing compounds include, but are not limited to, silver benzoates, a silver substituted-benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates comprising hydrocarbon chains incorporating ether or thioether linkages, or sterically hindered substitution in the α-(on a hydrocarbon group) or ortho- (on an aromatic group) position, and displaying increased solubility in coating solvents and providing coatings with less light scattering can also be used. Such silver carboxylates are described in U.S. Pat. No. 5,491,059 (noted above). Mixtures of any of the silver salts described herein can also be used if desired.

Silver salts of sulfonates are also useful in the practice of this invention. Such materials are described for example in U.S. Pat. No. 4,504,575 (Lee). Silver salts of sulfosuccinates are also useful as described for example in EP 0 227 141A1 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-amino-thiadiazole, a silver salt of 2-(2-ethylglycolamido)benzothiazole, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 15 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,201,678 (Meixell)].

Furthermore, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof.

Moreover, silver salts of acetylides and acetylenes can also be used as described, for example in U.S. Pat. No. 4,761,361 (Ozaki et al.) and U.S. Pat. No. 4,775,613 (Hirai et al.).

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films a silver carboxylate full soap, containing not more than about 15% of free carboxylic acid and analyzing for about 22% silver, can be used. For opaque photothermographic materials, different amounts can be used.

Another useful source of non-photosensitive reducible silver ions in the practice of this invention are the silver dimer compounds that comprise two different silver salts as described in copending U.S. Ser. No. 09/812,597 filed Mar. 20, 2001 by Whitcomb. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

In addition, the non-photosensitive silver compounds can be prepared as mixtures of non-photosensitive silver compounds. One such mixture can be prepared by the sequential formation of a second non-photosensitive silver compound in the presence of a previously prepared non-photosensitive silver compound. Such compounds have been referred to as "core-shell" silver salts. The preparation of such compositions would be readily apparent from the teaching provided herein as well as that provided in U.S. Pat. No. 6,355,408 (Whitcomb et al.).

The methods used for making silver soap dispersions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

It is particularly preferred that the non-photosensitive source of reducible silver ions be provided in the form of an aqueous nanoparticulate dispersion of silver salt particles (such as silver carboxylate particles). The silver salt particles in such dispersions generally have a weight average particle size of less than 1000 nm when measured by any useful technique such as sedimentation field flow fractionation, photon correlation spectroscopy, or disk centrifugation. Obtaining such small silver salt particles can be achieved using a variety of techniques that are described in the copending applications identified in the following paragraphs, but generally they are achieved using high speed milling using a device such as those manufactured by Morehouse-Cowles and Hochmeyer. The details for such milling are well known in the art.

Such dispersions also advantageously include a surface modifier so the silver salt can more readily be incorporated into aqueous-based photothermographic formulations. Useful surface modifiers include, but are not limited to, vinyl polymers having an amino moiety, such as polymers prepared from acrylamide, methacrylamide, or derivatives thereof, as described in U.S. Pat. No. 6,391,537 (Lelental et al.), incorporated herein by reference. A particularly useful surface modifier is dodecylthiopolyacrylamide that can be prepared as described in the noted copending application using the teaching provided by Pavia et al., *Makromolecular Chemie*, 193(9), 1992, pp. 2505–17.

Other useful surface modifiers are phosphoric acid esters, such as mixtures of mono- and diesters of orthophosphoric acid and hydroxy-terminated, oxyethylated long-chain alcohols or oxyethylated alkyl phenols as described for example in U.S. Pat. No. 6,387,611 (Lelental et al.), incorporated herein by reference. Particularly useful phosphoric acid esters are commercially available from several manufacturers under the trademarks or tradenames EMPHOS™ (Witco Corp.), RHODAFAC (Rhone-Poulenc), T-MULZ® (Hacros Organics), and TRYFAC (Henkel Corp./Emery Group).

Such dispersions contain smaller particles and narrower particle size distributions than dispersions that lack such surface modifiers. Particularly useful nanoparticulate dispersions are those comprising silver carboxylates such as silver salts of long chain fatty acids having from 8 to 30 carbon atoms, including, but not limited to, silver behenate, silver caprate, silver hydroxystearate, silver myristate, silver palmitate, and mixtures thereof. Silver behenate nanoparticulate dispersions are most preferred. These nanoparticulate dispersions can be used in combination with the conventional silver salts described above, including but not limited to, silver benzotriazole, silver imidazole, and silver benzoate.

The one or more non-photosensitive sources of reducible silver ions are preferably present in an amount of about 5% by weight to about 70% by weight, and more preferably, about 10% to about 50% by weight, based on the total dry weight of the emulsion layer. Stated another way, the amount of the sources of reducible silver ions is generally present in an amount of from about 0.001 to about 0.2 mol/m$^2$ of the dry photothermographic material, and preferably from about 0.01 to about 0.05 mol/m$^2$ of that material.

Reducing Agents

The reducing agent (or reducing agent composition comprising two or more components) for the source of reducible silver ions can be any material, preferably an organic material, that can reduce silver (1+) ion to metallic silver. The reducing agent is often referred to as a developer or developing agent.

Conventional photographic developers can be used as reducing agents, including aromatic di- and tri-hydroxy compounds (such as hydro-quinones, gallaic acid and gallic acid derivatives, catechols, and pyrogallols), aminophenols (for example, N-methylaminophenol), p-phenylenediamines, alkoxynaphthols (for example, 4-methoxy-1-naphthol), pyrazolidin-3-one type reducing agents (for example PHENIDONE®), pyrazolin-5-ones, polyhydroxy spiro-bis-indanes, indan-1,3-dione derivatives, hydroxytetrone acids, hydroxy-tetronimides, hydroxylamine derivatives such as for example those described in U.S. Pat. No. 4,082,901 (Laridon et al.), hydrazine derivatives, hindered phenols, amidoximes, azines, reductones (for example, ascorbic acid and ascorbic acid derivatives), leuco dyes, and other materials readily apparent to one skilled in the art.

Ascorbic acid reducing agents can also be used. An "ascorbic acid" reducing agent means ascorbic acid, complexes, and derivatives thereof. Ascorbic acid developing agents are described in a considerable number of publications in photographic processes, including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al.), EP 0 585 792A1 (Passarella et al.), EP 0 573 700A1 (Lingier et al.), EP 0 588 408A1 (Hieronymus et al.), U.S. Pat. No. 5,089,819 (Knapp), U.S. Pat. No. 5,278,035 (Knapp), U.S. Pat. No. 5,384,232 (Bishop et al.), U.S. Pat. No. 5,376,510 (Parker et al.), Japanese Kokai 7–56286 (Toyoda), U.S. Pat. No. 2,688,549 (James et al.), and *Research Disclosure*, item 37152, March 1995. D- , L-, or D,L-ascorbic acid (and alkali metal salts thereof) or isoascorbic acid (or alkali metal salts thereof) are preferred. Sodium ascorbate and sodium isoascorbate are most preferred. Mixtures of these developing agents can be used if desired.

When used with a silver carboxylate silver source, hindered phenolic reducing agents are preferred. In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes of reducing agents described below.

Hindered phenol reducing agents are preferred (alone or in combination with one or more high-contrast co-developing agents and co-developer contrast enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl) methanes, bis(hydroxyphenyl)methanes (that is bisphenols), hindered phenols, and hindered naphthols, each of which may be variously substituted, many of which are described in U.S. Pat. No. 3,094,417 (Workman) and U.S. Pat. No. 5,262,295 (Tanaka et al.), both incorporated herein by reference.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichloro-biphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX® or PERMANAX WSO), 1'-bis(3,5-di-t-butyl-4-hydroxyphenyl)methane, 2,2'-bis(4-hydroxy-3-methylphenyl)propane, 4,4'-ethylidene-bis(2-t-butyl-6-methylphenol), 2,2'-isobutylidene-bis(4,6-dimethylphenol) (LOWINOX® 221B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 5 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems including amidoximes such as phenylamidoxime, 2-thienyl-amidoxime and p-phenoxyphenylamidoxime, azines (for example, 4-hydroxy-3,5-dimethoxybenzaldehydrazine), a combination of aliphatic carboxylic acid aryl hydrazides and ascorbic acid [such as 2,2'-bis(hydroxymethyl)-propionyl-β-phenyl hydrazide in combination with ascorbic acid], a combination of polyhydroxybenzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenyl-acetate and ethyl α-cyanophenylacetate), bis-o-naphthols [such as 2,2'-dihydroxyl-1-binaphthyl, 6,6'-dibromo-2,2'-dihydroxy- 1,1'-binaphthyl, and bis(2-hydroxy-1-naphthyl)methane], a combination of bis-o-naphthol and a 1,3-dihydroxy-benzene derivative (for example, 2,4-dihydroxybenzophenone or 2,4-dihydroxy-acetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), indane-1,3-diones (such as 2-phenyl-indane-1,3-dione), chromans (such as 2,2-dimethyl-7-t-butyl-6-hydroxychroman), 1,4-dihydropyridines (such as 2,6-dimethoxy-3,5-dicarbethoxy-1,4-dihydro-pyridine), ascorbic acid derivatives (such as 1-ascorbylpalmitate, ascorbylstearate and unsaturated aldehydes and ketones), and 3-pyrazolidones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in U.S. Pat. No. 6,387,605 (Lynch et al.), incorporated herein by reference. Examples of these compounds include, but are not limited to, 2,5-dioxo-cyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene- 1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference. Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene)cyanoacetates and their metal salts.

Various contrast enhancing agents can be used in some photo-thermographic materials with specific co-developers. Examples of useful contrast enhancing agents include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as. described for example, in U.S. Pat. No. 5,558,983 (Simpson et al.), and hydrogen atom donor compounds as described in U.S. Pat. No. 5,637,449 (Harring et al.). All of the patents above are incorporated herein by reference.

Particularly useful compounds are reducing catechol-type reducing agents having no more than two hydroxy groups in an ortho-relationship. Preferred catechol-type reducing agents include, for example, catechol, 3-(3,4-dihydroxy-phenyl)-propionic acid, 2,3-dihydroxy-benzoic acid, 2,3-dihydroxy-benzoic acid esters, 3,4-dihydroxy-benzoic acid, and 3,4-dihydroxy-benzoic acid esters.

One particularly preferred class of catechol-type reducing agents are benzene compounds in which the benzene nucleus is substituted by no more than two hydroxy groups which are present in 2,3-position on the nucleus and have in the 1-position of the nucleus a substituent linked to the nucleus by means of a carbonyl group. Compounds of this type include 2,3-dihydroxy-benzoic acid, methyl 2,3-dihydroxy-benzoate, and ethyl 2,3-dihydroxy-benzoate.

Another particularly preferred class of catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group. Compounds of this type include, for example, 3,4-dihydroxy-benzoic acid, methyl 3,4-dihydroxy-benzoate, ethyl 3,4-dihydroxy-benzoate, 3,4-dihydroxy-benzaldehyde, and phenyl-(3,4-dihydroxyphenyl)ketone. Such compounds are described, for example, in U.S. Pat. No. 5,582,953 (Uyttendaele et al.).

Still another particularly useful class of reducing agents are polyhydroxy spiro-bis-indane compounds described as photographic tanning agents in U.S. Pat. No. 3,440,049 (Moede). Examples include 3,3,3',3'-tetramethyl-5,6,5',6'-tetrahydroxy-1,1'-spiro-bis-indane (called indane I) and 3,3,3',3'-tetramethyl-4,6,7,4',6',7'-hexahydroxy- 1,1'-spiro-bis-indane (called indane II).

Aromatic di- and tri-hydroxy reducing agents can also be used in combination with hindered phenol reducing agents either together or in combination with one or more high contrast co-developing agents and co-developer contrast-enhancing agents. These materials are described above.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Most hindered phenols used as reducing agents in thermally developable materials are naturally crystalline materials, and when incorporated as solid-particle dispersions, they retain their crystalline nature. The hindered phenols can be crystalline, but in some embodiments, non-crystalline or amorphous compounds are used.

By "non-crystalline", we mean that the reducing agent composition exhibits no birefringence when examined by optical microscopy using polarized light.

Particularly useful mixtures of hindered phenols are mixtures of bisphenols. One particularly useful mixture includes 2,2'-(2-methylpropylidene)bis(4,6-dimethylphenol) and 2,2'-(3,5,5-trimethylhexylidene)bis(4,6-dimethyl-phenol).

While the non-crystalline form of hindered phenols can be obtained in any conventional manner, in preferred embodiments, they are provided in what are known as "evaporated dispersions" that have reduced the likelihood of crystallization during and after coating. Such dispersions are prepared by dissolving two or more crystalline hindered phenol silver ion reducing agents in one or more "low boiling" organic solvents to provide a solvent solution. By "low boiling" organic solvents is meant solvents that have a boiling point less than 150° C. under atmospheric pressure. Examples of such solvents include, but are not limited to, lower alkyl acetates (such as methyl acetate, ethyl acetate, n-propyl acetate, isopropyl acetate, and butyl acetates), lower alkyl propionates (such as methyl propionate and ethyl propionate), chlorinated hydrocarbons (such as carbon tetrachloride, sym-dichloroethylene, trichloroethylene, 1,2-dichloropropane, and chloroform), amyl chloride, diethyl carbonate, ketones (such as diethyl ketone, methyl ethyl ketone, methyl -n-propylketone, and diethyl ketone), diisopropyl ether, cyclohexane, methylcyclohexane, ligroin, benzene, toluene, xylene, nitromethane, and other water-immiscible organic solvents that would be readily apparent to one skilled in the art.

Low boiling water-miscible organic solvents can also be used. These include, but are not limited to, alcohols (such as methanol, ethanol, and isopropanol), dimethylsulfoxide, tetrahydrofuran, N-methyl-pyrrolidone, dioxane, acetone, butyrolactone, ethylene glycol, ethylene glycol monomethyl ether, ethylene glycol monoethyl ether, ethylene glycol monobutyl ether, glycerol, acetonitrile, formamide, N,N-dimethylformamide, tetrahydrothiophene dioxide, and dimethoxyethane. Other useful solvents are described in U.S. Pat. No. 4,430,421 (Van de Sande et al.) and references cited therein. Ethyl acetate is the most preferred low boiling organic solvent. Generally, up to 50 weight % of the crystalline hindered phenols is dissolved in the one or more low boiling solvents at the beginning of this process.

The hindered phenols described herein can be dissolved within the one or more low boiling organic solvents at any suitable temperature from room temperature up to the boiling point of the low boiling organic solvents.

The non-crystalline reducing agent composition may also include one or more "permanent" high boiling organic solvents as long as they comprise less than 50 volume % of the total composition solvent volume. Preferably, the compositions of this invention comprise less than 10 volume % of such "permanent" high boiling organic solvents and more preferably, they include no "permanent" high boiling organic solvents. Such solvents generally have a boiling point greater than 150° C. and are also known in the art as "oil-formers" as described for example in U.S. Pat. No. 4,430,421 (noted above). This patent is incorporated herein by reference for its listing (Col. 9) of representative "oil-formers" or "permanent" organic solvents.

The resulting solvent solution is combined or mixed with one or more hydrophilic binders and one or more surfactants (usually in an aqueous solution or phase) to form a two-phase mixture. Suitable hydrophilic binders are described below but gelatin, gelatin derivatives, hydroxy-substituted cellulosic materials, and poly(vinyl alcohol) are preferred. The hydrophilic binders are generally present in the aqueous phase in an amount of from about 1 to about 20 weight %, and preferably about 4 to about 12 weight %.

A surfactant is usually present in the aqueous phase in an amount of at least 0.1 weight % and preferably from about 0.2 to about 2 weight %. Any suitable anionic, nonionic, cationic, or amphoteric surfactant can be used. Preferably, useful surfactants are anionic in nature and include, but are not limited to, alkali metal salts of an alkarylene sulfonic acid such as the sodium salt of dodecyl benzene sulfonic acid or sodium salts of isopropylnaphthalene sulfonic acids, such as mixtures of di-isopropyl- and triisopropylnaphthalene sodium sulfonates; an alkali metal salt of an alkyl sulfuric acid, such as sodium dodecyl sulfate, or an alkali metal salt of an alkyl sulfosuccinate, such as sodium bis(2-ethylhexyl) succinic sulfonate.

The resulting two-phase mixture is then emulsified or mixed in a suitable fashion, which generally means mixing in a suitable mechanical device that provides high shear or turbulent mixing. Such devices include, but are not limited to, colloid mills, homogenizers, microfluidizers, high-speed mixers, high speed mixers, ultrasonic dispersing apparatus, blade mixers, Gaulin mills, blenders, and other devices known in the art for this purpose. More than one type of device can be used for emulsification. The resulting two-phase mixture comprises small droplets of the organic phase suspended in the aqueous phase. The dispersion droplets generally have an average particle size of less than 10 $\mu$m, and preferably of from about 0.05 to about 3 $\mu$m.

The low boiling organic solvent(s) can be removed from the two-phase mixture using any suitable method including evaporation, noodle washing, and membrane dialysis, all of which are conventional procedures. Preferably, low boiling organic solvent removal is achieved by evaporation.

Once the low boiling organic solvents are removed, the resulting non-crystalline reducing agent composition comprising the two or more originally crystalline hindered phenols is generally mixed with the other components of a thermally sensitive emulsions or formulation including one or more non-photosensitive sources of reducible silver ions and one or more photosensitive silver halides, in any suitable order. Alternatively, the reducing agent composition can be coated as a separate layer in the photothermographic materials.

The hindered phenol reducing agent composition is generally present in an amount of from about 5 to about 30% (dry weight) of an emulsion layer. In multilayer constructions, if the reducing agents are added to a layer other than an emulsion layer, slightly higher amounts may be used. Any contrast enhancing agents are present in conventional amounts.

For color photothermographic imaging materials (for example, monochrome, dichrome, or full color images), one or more reducing agents can be used that can be oxidized directly or indirectly to form or release one or more dyes.

The dye-forming or releasing compound may be any colored, colorless, or lightly colored compound that can be oxidized to a colored form, or to release a preformed dye when heated, preferably to a temperature of from about 80° C. to about 250° C. for a duration of at least 1 second. When used with a dye- or image-receiving layer, the dye can diffuse through the imaging layers and interlayers into the image-receiving layer of the photothermographic material.

Leuco dyes or "blocked" leuco dyes are one class of dye-forming compounds (or "blocked" dye-forming compounds) that form and release a dye upon oxidation by silver ion to form a visible color image in the practice of the present invention. Leuco dyes are the reduced form of dyes that are generally colorless or very lightly colored in the visible region (optical density of less than 0.2). Thus, oxidation provides a color change that is from colorless to colored, an optical density increase of at least 0.2 units, or a substantial change in hue.

Representative classes of useful leuco dyes include, but are not limited to, chromogenic leuco dyes (such as indoaniline, indophenol, or azomethine dyes), imidazole leuco dyes such as 2-(3,5-di-t-butyl-4-hydroxy-phenyl)-4,5-diphenylimidazole as described for example in U.S. Pat. No. 3,985,565 (Gabrielson et al.), dyes having an azine, diazine, oxazine, or thiazine nucleus such as those described for example in U.S. Pat. No. 4,563,415 (Brown et al.), U.S. Pat. No. 4,622,395 (Bellus et al.), U.S. Pat. No. 4,710,570 (Thien), and U.S. Pat. No. 4,782,010 (Mader et al.), and benzlidene leuco compounds as described for example in U.S. Pat. No. 4,932,792 (Grieve et al.), all incorporated herein by reference. Further details about the chromogenic leuco dyes noted above can be obtained from U.S. Pat. No. 5,491,059 (noted above, Column 13) and references noted therein.

Another useful class of leuco dyes includes what are known as "aldazine" and "ketazine" leuco dyes that are described for example in U.S. Pat. No. 4,587,211 (Ishida et al.) and U.S. Pat. No. 4,795,697 (Vogel et al.), both incorporated herein by reference.

Still another useful class of dye-releasing compounds includes those that release diffusible dyes upon oxidation. These are known as preformed dye release (PDR) or redox dye release (RDR) compounds. In such compounds, the reducing agents release a mobile preformed dye upon oxidation. Examples of such compounds are described in U.S. Pat. No. 4,981,775 (Swain), incorporated herein by reference.

Further, other useful image-forming compounds are those in which the mobility of a dye moiety changes as a result of an oxidation-reduction reaction with silver halide, or a nonphotosensitive silver salt at high temperature, as described for example in JP Kokai 165,054/84.

Still further, the reducing agent can be a compound that releases a conventional photographic dye forming color coupler or developer upon oxidation as is known in the photographic art.

The dyes that are formed or released can be the same in the same or different imaging layers. A difference of at least 60 nm in reflective maximum absorbance is preferred. More preferably, this difference is from about 80 to about 100 nm. Further details about the various dye absorbance are provided in U.S. Pat. No. 5,491,059 (noted above, Col. 14).

The total amount of one or more dye-forming or -releasing compound that can be incorporated into the photothermographic materials of this invention is generally from about 0.5 to about 25 weight % of the total weight of each imaging layer in which they are located. Preferably, the amount in each imaging layer is from about 1 to about 10 weight %, based on the total dry layer weight. The useful relative proportions of the leuco dyes would be readily known to a skilled worker in the art.

Toners and Development Promoters

An essential component of the thermally sensitive emulsions and photothermographic materials of this invention are phthalazine N-oxide or derivatives thereof as the predominant source of "toners". Such compounds are believed to be "precursors" that provide or release phthalazine or derivatives thereof into the emulsion or material as "toners" in the traditional sense. These toner precursors also provide increased development at lower processing temperatures, thereby extending the usable temperature range of the photothermographic material. Phthalazine N-oxide or derivatives thereof also offer the benefit of less unwanted spectral-sensitized speed reduction and improved keeping of the photothermographic materials.

The phthalazine N-oxide or derivatives thereof are present in the thermally sensitive emulsions of this invention in an amount of at least 3.8 mmole per mole of total silver and preferably; at from about 4 to about 800 mmole per mole of total silver. In the photothermographic materials, these compounds are generally present in an amount of from about 0.01 g/m$^2$ and preferably from about 0.02 to about 2 g/m2 in one or more layers. These toner precursors can be present in any of the front side layers, and particularly in one or more photothermographic emulsion layers. Most preferably, they are in a single aqueous-based photothermographic emulsion layer with all of the necessary imaging components (photosensitive silver halide, non-photosensitive source of reducible silver ions, and reducing agent composition).

The toner precursors can be represented by the following Structure (I)

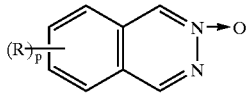

wherein R represents the same or different monovalent substituents such as halo groups (fluoro, bromo, chloro, or iodo), substituted or unsubstituted alkyl groups having 1 to 24 carbon atoms (such as methyl, ethyl, isopropyl, t-butyl, and docosanyl groups), substituted or unsubstituted alkoxy groups having 1 to 24 carbon atoms (such as methoxy, 2-ethoxy, t-butoxy, and n-heptoxy), substituted or unsubstituted phenoxy groups (such as 3-methylphenoxy), nitro groups, cyano groups, carboxy (or salts), and sulfo (or salts) groups. In addition, if two or more of the substituents are attached 1 or 2 carbon atoms distant from each other, they can form an aliphatic, aromatic, or heterocyclic ring with the phthalazine ring shown in Structure I. A wide variety of substituents are possible and include some or all of those described in Columns 5–8 of U.S. Pat. No. 6,146,822 (Asanuma et al.), incorporated herein by reference. Preferred R groups include halo, lower alkyl (1 to 4 carbon atoms), cyano, carboxy, and sulfo groups.

Also, in Structure I, p is an integer of 0 to 4. Preferably, p is 0 or 1, and most preferably, it is 0. Thus, when p is 2,3, or 4, the "R" substituents can be the same or different.

Thus, besides the preferred compound of phthalazine N-oxide, additional phthalazine N-oxide derivatives can be designed similar to the phthalazine derivatives shown in Columns 8–17 of U.S. Pat. No. 6,146,822 (noted above). Representative toner precursors useful in the practice of this invention are the following Compounds I-1 through I–31. Compound I-1 is most preferred.

(I-1)

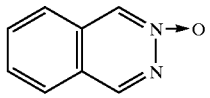

(I-2)

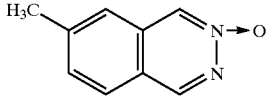

-continued (I-3)

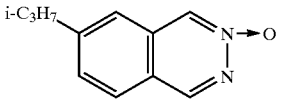

(I-4)

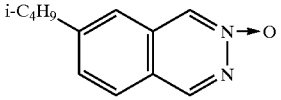

(I-5)

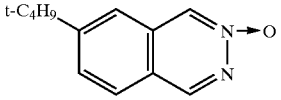

(I-6)

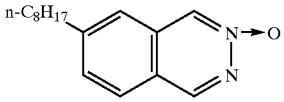

(I-7)

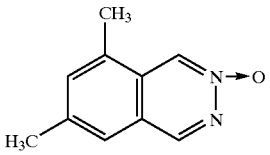

(I-8)

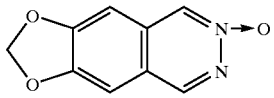

(I-9)

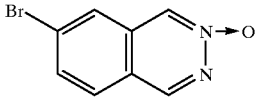

(I-10)

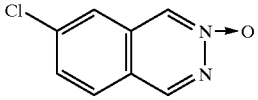

(I-11)

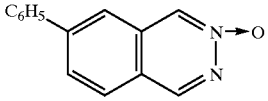

(I-12)

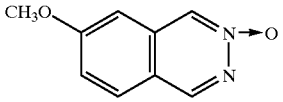

(I-13)

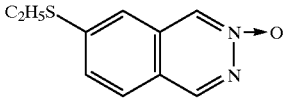

(I-14)

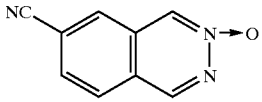

(I-15)

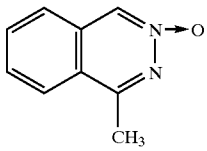

-continued (I-16)

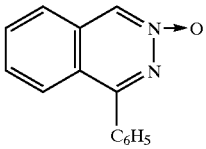

(I-17)

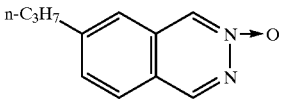

(I-18)

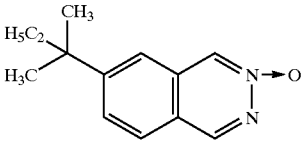

(I-19)

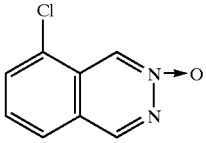

(I-20)

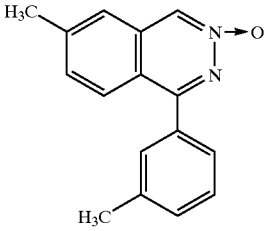

(I-21)

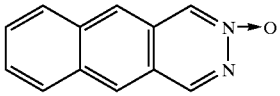

(I-22)

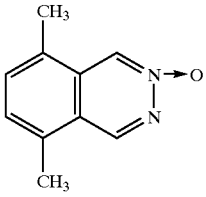

(I-23)

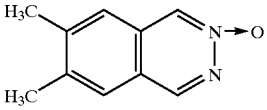

(I-24)

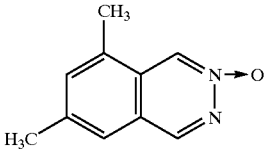

(I-25)

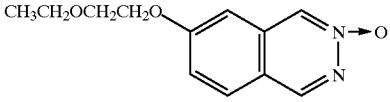

-continued (I-26)

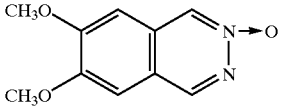

(I-27)

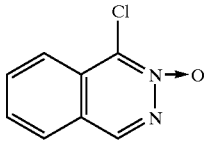

(I-28)

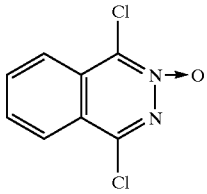

(I-29)

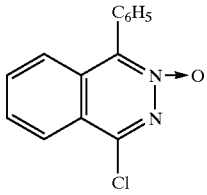

(I-30)

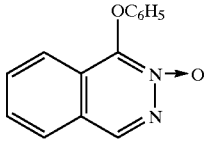

(I-31)

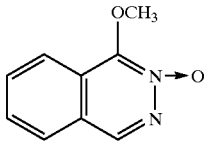

The phthalazine N-oxide compounds useful in this invention can be prepared using known starting materials and reaction conditions. A representative preparation is provided below just before the examples.

The present invention exhibits the most desirable advantages when the thermally sensitive emulsion also includes a "development promoter" that also sometimes also known in the art as toners, but in the present invention, they are believed to enhance development, increasing $D_{max}$, contrast, and photographic speed.

The development promoters are present in the thermally sensitive emulsions of this invention in an amount of at least 10 mmole per mole of total silver and preferably at from about 20 to about 700 mmole per mole of total silver. In the photothermographic materials, these compounds are generally present in an amount of from about 3 mg/$M^2$ and preferably from about 6 to about 1300 mg/$M^2$ in one or more layers. These development promoters can be present in any of the front side layers, and particularly in one or more photothermographic emulsion layers. Most preferably, they are in a single aqueous-based photothermographic emulsion layer with all of the necessary imaging components (photosensitive silver halide, non-photosensitive source of reducible silver ions, reducing agent composition, and phthalazine N-oxide or derivative thereof).

Useful classes of compounds that can used as development promoters in the present invention include cyclic imides (such as succinimide, phthalimide, and naphthalimide), benzoxazine diones, benzthiazine diones, quinazoline diones, and phthalazinones. Succinimide is the most preferred development promoter.

The benzoxazine diones, benzthiazine diones, and quinazoline diones can be generally represented by the following Structure II:

(II)

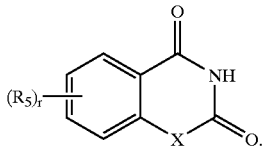

In Structure II, $R_5$ independently represents one or more hydrogen, alkyl groups, cycloalkyl groups, alkoxy groups, alkylthio groups, arylthio groups, hydroxy groups, halogen groups, or $N(R_8R_9)$ groups. In addition, any two $R_5$ groups can be taken together to represent the atoms necessary to form a fused aromatic, heteroaromatic, alicyclic, or heterocyclic ring. When $R_5$ represents an amino group $[N(R_8R_9)]$, $R_8$ and $R_9$ each independently represents hydrogen, an alkyl group, aryl group, cycloalkyl group, alkenyl group, or heterocyclic group. Additionally, $R_8$ and $R_9$ taken together can represent the atoms necessary to form a substituted or unsubstituted 5- to 7-membered heterocyclic ring. In Structure II, X represents O, S, Se, or $N(R_6)$, wherein $R_6$ represents hydrogen or an alkyl group, aryl group, cycloalkyl group, alkenyl group, or heterocyclic group. Finally, r is 0, 1, or 2.

Useful alkyl groups for $R_5$, $R_6$, $R_8$, and $R_9$ are linear, branched, or cyclic and can have from 1 to 20 carbon atoms, and preferably can have from 1 to 5 carbon atoms. Most preferable are alkyl groups of from 1 to 4 carbon atoms (such as methyl, ethyl, iso-propyl, n-butyl, t-butyl, and sec-butyl).

Useful aryl groups for $R_5$, $R_6$, $R_8$, and $R_9$ can have from 6 to 14 carbon atoms in the aromatic ring(s). Preferred aryl groups are phenyl groups and substituted phenyl groups.

Useful cycloalkyl groups for $R_5$, $R_6$, $R_8$, and $R_9$ can have from 5 to 14 carbon atoms in the central ring system. Preferred cycloalkyl groups are cyclopentyl and cyclohexyl.

Useful alkenyl and alkynyl groups can be branched or linear and have 2 to 20 carbon atoms. A preferred alkenyl group is allyl.

Useful heterocyclic groups for $R_5$, $R_6$, $R_8$, and $R_9$ can have 5 to 10 carbon, oxygen, sulfur, and nitrogen atoms in the central ring system and can also have fused rings.

These alkyl, aryl, cycloalkyl, and heterocyclic groups can be further substituted with one or more groups including but not limited to, halo groups, alkoxycarbonyl groups, hydroxy groups, alkoxy groups, cyano groups, acyl groups, acyloxy groups, carbonyloxy ester groups, sulfonic acid ester groups, alkylthio groups, dialkylamino groups, carboxy groups, sulfo groups, phosphono groups, and any other group readily apparent to one skilled in the art.

Useful alkoxy, groups, alkylthio groups, arylthio groups for $R_5$ are those having alkyl and aryl groups as described above.

Preferred halogen groups are chlorine and bromine.

Representative compounds of Structure II are the following Compounds II-1 through II-10. Compound II-1 is most preferred as a development promoter in this group of compounds.

(II-1)

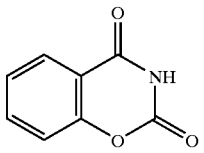

(II-2)

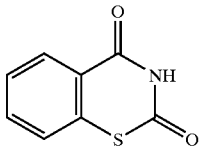

(II-3)

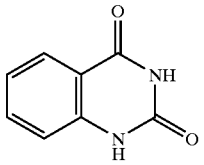

(II-4)

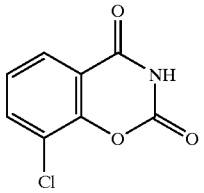

(II-5)

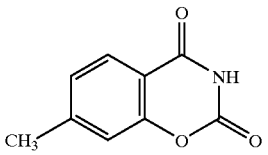

(II-6)

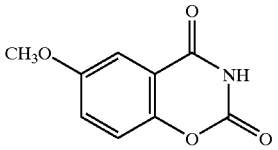

(II-7)

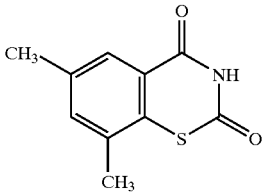

(II-8)

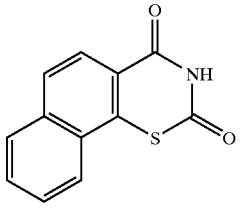

-continued (II-9)

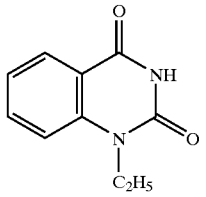

(II-10)

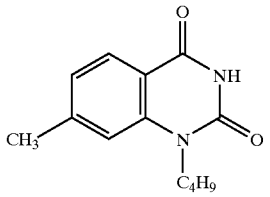

Other useful substituted benzoxazine diones are described in U.S. Pat. No. 3,951,660 (Hagemann et al.), incorporated herein by reference.

Phthalazinones can be represented by the following Structure III:

(III)

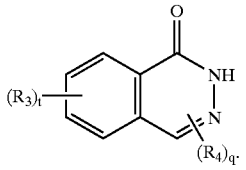

In Structure III, $R_3$ and R4 each independently represent hydrogen, alkyl groups, cycloalkyl groups, alkoxy groups, alkylthio groups, arylthio groups, hydroxy groups, halogen groups, or $N(R_8R_9)$ groups. In addition, and two of the $R_3$ and $R_4$ groups, taken together, can represent the atoms necessary to form a fused aromatic, heteroaromatic, alicyclic, or heterocyclic ring. When $R_3$ or $R_4$ represent an amino group $[N(R_8R_9)]$, $R_8$ and $R_9$ each independently represent hydrogen, alkyl groups, aryl groups, cycloalkyl groups, alkenyl groups, and heterocyclic groups, as defined above for $R_5$. Additionally, $R_8$ and $R_9$ taken together may represent the atoms necessary to form a substituted or unsubstituted 5- to 7-membered heterocyclic ring. In Structure III, t and q are independently 0,1, or 2.

Useful alkyl groups for $R_3$ and $R_4$ are linear, branched, or cyclic and can have from 1 to 20 carbon atoms, and preferably can have from 1 to 5 carbon atoms. Most preferable are alkyl groups of from 1 to 4 carbon atoms (such as methyl, ethyl, iso-propyl, n-butyl, t-butyl, and sec-butyl).

Useful aryl groups for $R_3$ and $R_4$ can have from 6 to 14 carbon atoms in the aromatic ring(s). Preferred aryl groups are phenyl groups and substituted phenyl groups.

Useful cycloalkyl groups for $R_3$ and $R_4$ can have from 5 to 14 carbon atoms in the central ring system. Preferred cycloalkyl groups are cyclopentyl and cyclohexyl.

Useful alkenyl and alkynyl groups can be branched or linear and have 2 to 20 carbon atoms. A preferred alkenyl group is allyl.

Useful heterocyclic groups for $R_3$ and $R_4$ can have 5 to 10 carbon, oxygen, sulfur, and nitrogen atoms in the central ring system and can also have fused rings.

These alkyl, aryl, cycloalkyl, and heterocyclic groups can be further substituted with one or more groups including but not limited to, halo groups, alkoxycarbonyl groups, hydroxy groups, alkoxy groups, cyano groups, acyl groups, acyloxy groups, carbonyloxy ester groups, sulfonic acid ester groups, alkylthio groups, dialkylamino groups, carboxy groups, sulfo groups, phosphono groups, and any other group readily apparent to one skilled in the art.

Useful alkoxy, groups, alkylthio groups, arylthio groups for $R_3$ and $R_4$ are those having alkyl and aryl groups as described above.

Preferred halogen groups are chlorine and bromine.

Representative compounds of Structure III are the following Compounds III-1 through III-4. Compound III-1 is most preferred as a development promoter in this group of compounds.

III-1

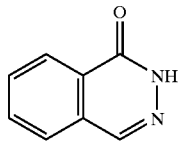

III-2

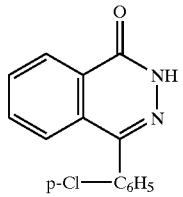

III-3

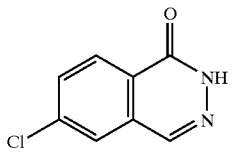

III-4

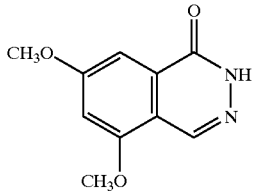

Other Addenda

The photothermographic materials of this invention can also contain other additives such as shelf-life stabilizers, antifoggants, contrast enhancers, acutance dyes, post-processing stabilizers or stabilizer precursors, thermal solvents (also known as melt formers), and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae Ar—S—$M^1$ and Ar—S—S—Ar, wherein $M^1$ represents a hydrogen atom or an alkali metal atom and Ar represents a heteroaromatic ring or fused hetero-aromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. For example, heteroaromatic mercapto compounds are described as supersensitizers for infrared photothermographic materials in EP 0 559 228 B1 (Philip Jr. et al.).

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenz-imidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

The photothermographic materials of the present invention can be further protected against the production of fog and can be stabilized against loss of sensitivity during storage. While not necessary for the practice of the invention, it may be advantageous to add mercury (2+) salts to the emulsion layer(s) as an antifoggant. Preferred mercury (2+) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

The photothermographic materials of this invention preferably include one or more water-soluble or water-dispersible antifoggants that have a pKa of 8 or less. In addition, they are represented by the following Structure IV:

$$R_1—SO_2—C(R_2)R_{10}—(CO)_m—(L)_n—SG \qquad \text{IV}$$

wherein $R_1$ is a substituted or unsubstituted aliphatic or cyclic group of any size as long as the antifoggant remains soluble or readily dispersible in water. Substituted or unsubstituted aliphatic groups for $R_1$ include monovalent groups having 1 to 20 carbon, nitrogen, sulfur, and oxygen atoms in the chain including, but not limited to, chains that include one or more substituted or unsubstituted alkyl groups (having 1 to 10 carbon atoms), substituted or unsubstituted alkenylene groups (having 2 to 20 carbon atoms), substituted or unsubstituted alkylenearylene groups (having 7 to 20 carbon atoms in the chain), and combinations of any of these groups, as well as combinations of these groups that are connected with one or more amino, amido, carbonyl, sulfonyl, carbonamido, sulfonamido, thio, oxy, oxycarbonyl, oxysulfonyl, and other connecting groups that would be readily apparent to one skilled in the art. The various types of useful aliphatic groups would be readily apparent to one skilled in the art.

Preferred aliphatic groups for $R_1$ include substituted or unsubstituted t-butyl and trifluoromethyl groups.

$R_1$ can also be substituted or unsubstituted cyclic groups including substituted or unsubstituted carbocyclic aryl groups (having 6 to 14 carbon atoms to form the cyclic ring), substituted or unsubstituted cycloalkylene groups (having 5 to 10 carbon atoms to form the cyclic ring) and heterocyclic groups (having 5 to 10 carbon, nitrogen, sulfur, or oxygen atoms to form the cyclic ring), both aromatic and nonaromatic. The various types of cyclic groups would be readily apparent to one skilled in the art.

Preferred cyclic groups for $R_1$ include substituted or unsubstituted aryl groups having 6 to 10 carbon atoms to form the cyclic ring. Substituted or unsubstituted phenyl groups are most preferred. Methyl groups are preferred substituents on the phenyl group.

More preferably, $R_1$ is 4-methylphenyl, phenyl, trifluoromethyl, adamantyl, or tertiary butyl.

In Structure IV, $R_2$ and $R_{10}$ are independently hydrogen or bromine as long as one of them is bromine. Preferably, both $R_2$ and $R_{10}$ are bromine.

In addition, L is a substituted or unsubstituted aliphatic divalent linking group that can have the same definition as $R_1$ except that L is divalent. Thus, one skilled in the art would be able to determine suitable L groups that would serve the desired purpose while maintaining compound water solubility or dispersibility. Preferably, L is an -NH-alkylene group wherein "alkylene" is substituted or unsubstituted and has 1 to 10 carbon atoms (more preferably 1 to 3 carbon atoms).

When m and n are each 1, L is preferably an —$N(CH_3)$-alkylene- or —NH-alkylene-group.

Substituents on $R_1$ and L can be any chemical moiety that would not adversely affect the desired function of the antifoggant and can include, but are not limited to, alkyl, aryl, heterocyclic, cycloalkyl, amino, carboxy, hydroxy, phospho, sulfonamido, sulfo, and other groups that would be readily apparent to one skilled in the art. The number of substituents is limited only by the number of available valences (available hydrogen atoms). Alkyl groups are preferred substituents for cyclic $R_1$ groups. However, as would be apparent, the antifoggants can have multiple sulfo, carboxy, phosphor and sulfonamido groups that impart water solubility to the molecule.

Further, in Structure IV, m and n are independently 0 or 1, and referably, both are 1.

SG can be any solubilizing group having a pKa of 8 or less that does not interfere with its antifogging activity. SG may be in the free acid form or it may be a salt, particularly a suitable metal salt (for example, an alkali metal salt) or ammonium ion salt. Preferably, SG is a salt. When SG is in its free acid form, the salt can be generated in situ by neutralization with any basic material commonly used by one skilled in the art. Preferably, SG is a carboxy, phospho, sulfo, or sulfonamido group. When SG is a sulfonamido group, it may be —$SO_2N^-COR_{11}M^+$, or —$NSO_2R_{11}M^+$ wherein $R_{11}$ is a substituted or unsubstituted aliphatic or cyclic group as defined from $R_1$. $R_1$ and $R_{11}$ can be the same or different group. More preferably, SG is a carboxy or sulfo group (or salts thereof), particularly when both m and n are 1.

$M^+$ is a suitable cation such as hydrogen or a metal cation (preferably an alkali metal cation) or an ammonium ion. When $M^+$ is a hydrogen atom, the resulting free acid can be easily solubilized by neutralization with a suitable base such as for example, potassium hydroxide or sodium bicarbonate.

In preferred embodiments, when m and n are both 0, SG is carboxy (or a salt thereof), sulfo (or a salt thereof), phospho (or a salt thereof), $—SO_2N^-COR_{11}M^+$, or $—NSO_2R_{11}M^+$ wherein $M^+$ is as defined above.

Additionally, when m and n are both 1, SG is carboxy (or a salt thereof), sulfo (or a salt thereof), phospho (or a salt thereof), or $—SO_2N^-COR_{11}M^+$ wherein $M^+$ is as defined above.

Moreover, when m is 1 and n is 0, SG is carboxy (or a salt thereof), sulfo (or a salt thereof), phospho (or a salt thereof), or $—N^-SO_2R_{11}M^+$ wherein $M^+$ is as defined above.

Further details about these preferred antifoggants are provided in copending U.S. Ser. No.10/014,961 filed Dec. 11, 2001 by Burgmaier and Klaus.

The antifoggants can be used individually or in combination in the photothermographic materials of this invention. Generally, they are present in an amount of at least 0.0001 mol/mol of total silver. Preferably, they are present in an amount of from about 0.001 to about 0.1 mol/mol of total silver.

Preferably, the antifoggants are included in the one or more photothermographic emulsion layers, but during manufacture, they can also be incorporated into interlayers, underlayers, and protective topcoat layers on the front side of the support. If they are placed in a non-emulsion layer, they tend to migrate-into the emulsion layer(s) where they become effective in reducing $D_{min}$.

Binders

The photosensitive silver halide (if present), the non-photosensitive source of reducible silver ions, the reducing agent composition, toners, and other additives used in the present invention are generally used in one or more binders that are predominantly hydrophilic in nature. Mixtures of such binders can also be used. By "predominantly" is meant that at least 50% by weight of the total binders are hydrophilic in nature. The rest may include one or more binders that are hydrophobic in nature. However, the formulations for the emulsion layers are prepared and coated out of aqueous coating solvents (meaning water and mixtures of water and water-miscible solvents where water is the predominant solvent).

Useful hydrophilic binders in the various layers (especially emulsion layers) include, but are not limited to, proteins and protein derivatives, "gelatins" such as gelatin and gelatin-like derivatives (hardened or unhardened, including alkali- and acid-treated gelatins, acetylated gelatin, oxidized gelatin, phthalated gelatin, and deionized gelatin), cellulosic materials such as hydroxymethyl cellulose and cellulose esters such as cellulose acetate and cellulose acetate butyrate, polysaccharides (such as dextrin), poly(silicic acid), hydroxymethyl cellulose, acrylamide/methacrylamide polymers, acrylic/methacrylic polymers, polyvinyl pyrrolidones, polyvinyl acetates, polyvinyl alcohols, poly(vinyl lactams), polymers of sulfoalkyl acrylate and methacrylates, hydrolyzed polyvinyl acetates, and polysaccharides (such as dextrans and starch ethers) and other synthetic or naturally-occurring vehicles commonly known for use in aqueous-based photographic emulsions (see for example, *Research Disclosure*, Item 38957). Cationic starches can be used as a peptizer for tabular silver halide grains as described in U.S. Pat. No. 5,620,840 (Maskasky) and U.S. Pat. No. 5,667,955 (Maskasky). Gelatin, gelatin derivatives, and poly(vinyl alcohol) are most preferred binders.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and Pioloform BS-18 or Pioloform BL-16 (Wacker Chemical Company).

Hardeners for various binders may be present if desired. Useful hardeners are well known and include diisocyanate compounds as described for example in EP-0 600 586B1, vinyl sulfone compounds as described in U.S. Pat. No. 6,143,487 (Philip, Jr. et al), and aldehydes and various other hardeners as described in U.S. Pat. No. 6,190,822 (Dickerson et al.). The hydrophilic binders used in the photothermographic materials are generally partially or fully hardened using any conventional hardener.

Where the proportions and activities of the photothermographic materials require a particular developing time and temperature, the binder(s) should be able to withstand those conditions. Generally, it is preferred that the binder be resistant to decomposition or loss of structural integrity at 120° C. for 60 seconds. It is more preferred that it not be decomposed or lose its structural integrity at 177° C. for 60 seconds.

The binders are used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The photothermographic materials can be prepared using a polymeric support that is preferably a flexible film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is a particularly useful support. Various support materials are described, for example, in *Research Disclosure*, August 1979, item 18431. A method of making dimensionally stable polyester films is described in *Research Disclosure*, September, 1999, item 42536.

It is also useful to use supports comprising dichroic mirror layers wherein the dichroic mirror layer reflects radiation at least having the predetermined range of wavelengths to the emulsion layer and transmits radiation having wavelengths outside the predetermined range of wavelengths. Such dichroic supports are described in U.S. Pat. No. 5,795,708 (Boutet), incorporated herein by reference.

It is further useful to use transparent, multilayer, polymeric supports comprising numerous alternating layers of at least two different polymeric materials. Such multilayer polymeric supports preferably reflect at least 50% of actinic radiation in the range of wavelengths to which the photothermographic sensitive material is sensitive, and provide photothermographic materials having increased speed. Such transparent, multilayer, polymeric supports are described in WO 02/21208 A1 (Simpson et al.), incorporated herein by reference.

Opaque supports can also be used such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Support materials may also be treated or annealed to reduce shrinkage and promote dimensional stability.

Formulations and Construction

The formulations for the emulsion layer(s) can be prepared by dissolving and dispersing the binder(s), the emulsion components, the reducing agent composition, toner, and optional addenda in an aqueous solvent that includes water and possibly minor amounts (less than 50 volume %) of a water-miscible solvent (such as acetone or a lower alcohol) to provide aqueous-based coating formulations.

The photothermographic materials of this invention can also contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads, including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP 0 792 476B1 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers, or other procedures described in the noted publication.

The photothermographic materials of this invention can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP 0 678 776A1 (Melpolder et al.). Other antistatic agents are well known in the art.

The photothermographic materials can be constructed of one or more layers on a support. Single layer materials should contain the photosensitive silver halide, the non-photosensitive source of reducible silver ions, the reducing agent composition, the toner, the development promoter, the hydrophilic binder, as well as optional materials such as acutance dyes, coating aids, and other adjuvants.

Two-layer constructions comprising a single imaging layer coating containing all the ingredients and a protective topcoat are generally found in the photothermographic materials. However, two-layer constructions containing photosensitive silver halide and non-photosensitive source of reducible silver ions in an emulsion layer (usually the layer adjacent to the support) and the reducing agent composition and other ingredients in a different layer or distributed between both layers are also envisioned. Generally, the multiple layers are coated out of water as described above. Thus, where the photothermographic materials comprise protective overcoat and/or antihalati6n layers, they are also generally coated as aqueous formulations.

Layers to promote adhesion of one layer to another are also known, as described for example, in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example, in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), and U.S. Pat. No. 6,420,102 (Bauer et al.), all incorporated herein by reference.

Protective overcoats or topcoats can also be present over the one or more emulsion layers. The overcoats are generally transparent are composed of one or more film-forming hydrophilic binders such as poly(vinyl alcohol), gelatin (and gelatin derivatives), and poly(silicic acid). A combination of poly(vinyl alcohol) and poly(silicic acid) is particularly useful. Such layers can further comprise matte particles, plasticizers, and other additives readily apparent to one skilled in the art.

The protective layer can also be a backing layer (such as an antihalation layer) that is on the backside of the support.

Preferred photothermographic materials of this invention comprise a protective overcoat on the imaging side, an antihalation layer on the backside, or both.

The thermally sensitive emulsions and other formulations described herein can be coated by various coating procedures including wire wound rod coating, dip coating, air knife coating, curtain coating, slide coating, or extrusion coating using hoppers of the type described in U.S. Pat. No.

2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford), all incorporated herein by reference. A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

Mottle and other surface anomalies can be reduced in the materials of this invention by incorporation of a fluorinated polymer as described for example, in U.S. Pat. No. 5,532,121 (Yonkoski et al.) or by using particular drying techniques as described, for example, in U.S. Pat. No. 5,621,983 (Ludemann et al.).

Preferably, two or more layers are applied to a film support using slide coating. The first layer can be coated on top of the second layer while the second layer is still wet.

While the first and second layers can be coated on one side of the film support, the manufacturing method can also include forming on the opposing or backside of said polymeric support, one or more additional layers, including an antihalation layer, an antistatic layer, or a layer containing a matting agent (such as silica), or a combination of such layers.

It is also contemplated that the photothermographic materials of this invention can include emulsion layers on both sides of the support and at least one infrared radiation absorbing heat-bleachable composition as an antihalation underlayer beneath at least one emulsion layer.

To promote image sharpness, photothermographic materials of this invention can contain one or more layers containing acutance and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials contain an antihalation coating on the support opposite to the side on which the emulsion and topcoat layers are coated.

Dyes useful as antihalation and acutance dyes include squaraine dyes described in U.S. Pat. No. 5,380,635 (Gomez et al.), U.S. Pat. No. 6,063,560 (Suzuki et al.), and EP 1 083 459A1 (Kimura), the indolenine dyes described in EP 0 342 810A1 (Leichter), and the cyanine dyes described in U.S. Ser. No. 10/011,892 (filed Dec. 5, 2001 by Hunt, Kong, Ramsden, and LaBelle). All of the above are incorporated herein by reference.

It is also useful in the present invention to employ compositions including acutance or antihalation dyes that will decolorize or bleach with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566, (Sakurada et al.), U.S. Published Application 2001-0001704 (Sakurada et al.), JP 2001-142175 (Hanyu et al.), and JP 2001-183770 (Hanye et al.). Also useful are bleaching compositions described in JP 11-302550 (Fujiwara), JP 2001-109101 (Adachi), JP 2001-51371 (Yabuki et al.), and JP 2000-029168 (Noro). All of the above are incorporated herein by reference.

Particularly useful heat-bleachable backside antihalation compositions can include an infrared radiation absorbing compound such as an oxonol dyes and various other compounds used in combination with a hexaarylbiimidazole (also known as a "HABI"), or mixtures thereof. Such HABI compounds are well known in. the art, such as U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in copending and commonly assigned U.S. Ser. No. 09/875,772 (filed Jun. 6, 2001 by Goswami, Ramsden, Zielinski, Baird, Weinstein, Helber, and Lynch) and U.S. Ser. No. 09/944,573 (filed Aug. 31, 2001 by Ramsden and Baird) both incorporated herein by reference.

Under practical conditions of use, the compositions are heated to provide bleaching at a temperature of at least 90° C. for at least 0.5 seconds.

Preferably, bleaching is carried out at a temperature of from about 110° C. to about 200° C. for from about 5 to about 20 seconds. Most preferred bleaching is carried out within 20 seconds at a temperature of from about 110° C. to about 130° C.

In preferred embodiments, the photothermographic materials of this invention include a surface protective layer on the same side of the support as the one or more thermally-developable layers, an antihalation layer on the opposite side of the support, or both a surface protective layer and an antihalation layer on their respective sides of the support.

Imaging/Development

While the photothermographic materials of this invention can be imaged in any suitable manner consistent with the type of material using any suitable imaging source (typically some type of radiation or electronic signal for photothermographic materials and some type of thermal source for thermographic materials), the following discussion will be directed to the preferred imaging means for photothermographic materials. Generally, the materials are sensitive to radiation in the range of from about 190 to about 850 nm (preferably from about 400 to about 850 nm).

Imaging can be achieved by exposing the photothermographic materials to a suitable source of radiation to which they are sensitive, including ultraviolet light, visible light, near infrared radiation and infrared radiation to provide a latent image. Suitable exposure means are well known and include laser diodes that emit radiation in the desired region, photodiodes and others described in the art, including *Research Disclosure*, September 1996, item 38957, (such as sunlight, xenon lamps and fluorescent lamps). Particularly useful exposure means uses laser diodes, including laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

For using the photothermographic materials, development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps.

Thermal development takes place at a higher temperature for a shorter time (for example, at about 150° C. for up to 10 seconds), followed by thermal diffusion at a lower temperature (for example, at about 80° C.) in the presence of a transfer solvent.

The following examples are representative of the present invention and its practice and are not meant to be limiting in any manner.

METHODS AND MATERIALS FOR THE EXAMPLES

All materials used in the following examples are readily available from standard commercial sources or prepared using known procedures and starting materials unless otherwise specified. All percentages are by weight unless otherwise indicated.

Antifoggant AF-1 is 2,2'-dibromo-(4-methylphenyl)sulfonyl-N-(2-sulfoethyl)acetamide, potassium salt, and has the following structure:

AF-1

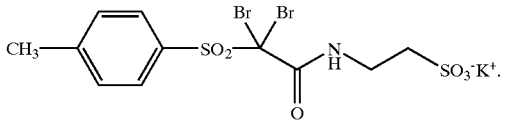

Antifoggant AF-1 can be prepared as follows:

To a 5-liter flask equipped with a mechanical stirrer and reflux condenser was added p-toluenesulfinic acid, lithium salt (308.57 g), N-(2-sulfoethyl)-2-bromoacetamide, lithium salt (527.39 g), water (180 ml), and ethyl alcohol (3380 ml). The resulting suspension was heated to reflux. After about an hour of reflux, nearly all of the reactants had dissolved. Reflux was continued another four hours, and the solution was filtered hot through a Celite pad to remove some haziness. The solution was cooled overnight to room temperature. The solid that formed was collected and washed with 1 liter of 95% ethyl alcohol/water. The white solid was air dried and then dried at high vacuum, providing 553.88 g (89% yield) of $^{2}$-(4-methylphenyl)sulfonyl-N-(2-sulfoethyl) acetamide, lithium salt (Intermediate 1). HPLC analysis showed no detectable impurities. Ion chromatography indicated 0.035 weight % bromide and 1.8 weight % lithium. The material exhibited an acceptable proton spectrum.

To glacial acetic acid (660 ml) was added Intermediate 1 (98.19 g), and 1,3-dibromo-5,5-dimethylhydantoin (42.89 g). The resulting suspension was heated to reflux where solution occurred. After about 3–5 minutes at reflux, the slight bromine color was discharged, and reflux was continued to another 15 minutes. Analysis of the reaction mixture by HPLC indicated conversion to one main product. After cooling to near room temperature, most of the acetic acid was removed on the rotary film evaporator using a water aspirator (water bath temperature at 40° C.). The residue was diluted with 2500 ml of ethyl alcohol. Complete solution occurred after stirring the suspension for one hour at room temperature. To this stirring solution at room temperature was added dropwise a solution of potassium acetate (58.88 g) dissolved in ethyl alcohol (500 ml). A white solid formed immediately. Upon complete addition of the potassium acetate solution, the suspension was stirred at room temperature for 90 minutes, and the desired antifoggant AF-1,2,2-dibromo-2-(4-methylphenyl)sulfonyl-N-(2-sulfoethyl)acetamide, potassium salt, was collected by filtration and washed with ethyl alcohol. The solid was then dried under high vacuum at 40° C. The yield of crude antifoggant AF-1, which had a slight odor of acetic acid, was 145.22 g (94%).

Two separate synthetic batches of AF-1 were made, combined, and recrystallized by dissolving 182.33 g of product in a mixture of water (85 ml) and ethyl alcohol (600 ml) while boiled, filtered hot, and adding about 7 ml water upon cooling to prevent oiling. After letting the solution stand overnight at room temperature, the desired antifoggant product was collected and washed with about 300 ml (10:1 v/v) ethyl alcohol/water mixture. The product was then air-dried and then dried under high vacuum at 40° C., providing 159.87 g of desired product. HPLC analysis indicated an assay of 99.2% of the desired component. The product exhibited the expected proton NMR spectrum and mass spectrum consistent with the AF-1structure shown above.

Antifoggant AF-2 is 2-bromo-2-(4-methylphenylsulfonyl)acetamide, can be obtained using the teaching provided in U.S. Pat. No. 3,955,982 (Van Allan), and has the following structure:

AF-2

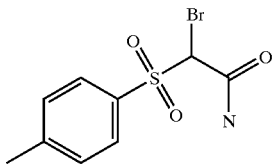

D-1

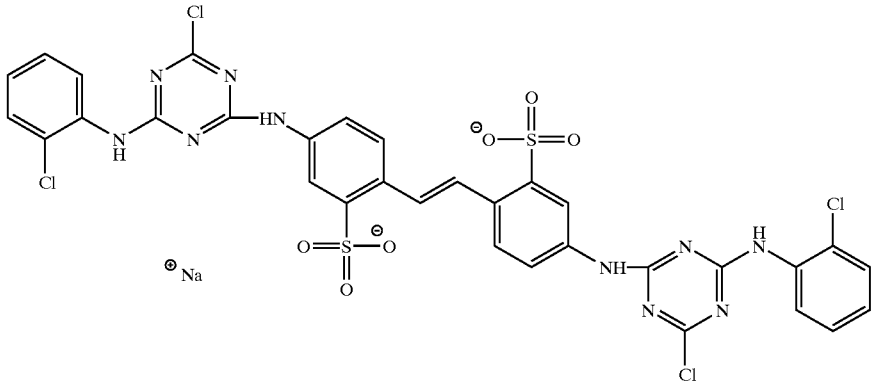

D-2

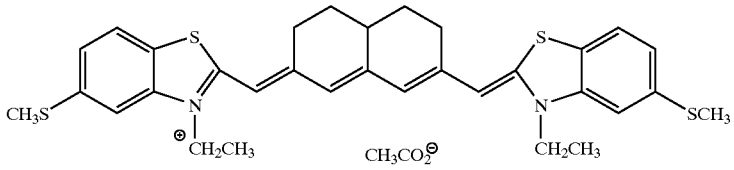

DEV-1

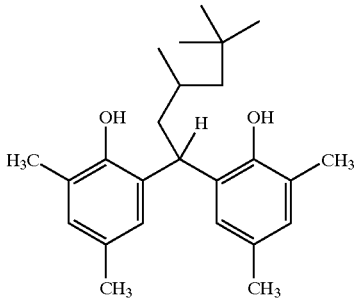

Developer

A) Preparation of Nanoparticulate Silver Behenate

A reactor was initially charged with demineralized water, a 10% solution of dodecylthiopolyacrylamide surfactant (72 g), and behenic acid [46.6 g, nominally 90% behenic acid (Unichema) recrystallized from isopropanol]. The reactor contents were stirred at 150 rpm and heated to 70° C. at which time a 10.85% w/w KOH solution (65.1 g) were added to the reactor. The reactor contents were then heated to 80° C. and held for 30 minutes until a hazy solution was achieved. The reaction mixture was then cooled to 70° C. and a silver nitrate solution consisting of silver nitrate (166.7g of 12.77% solution) was added to the reactor at a controlled rate during 30 min. The reactor contents were then held at the reaction temperature for 30 minutes, cooled to room temperature, and decanted. A nanoparticulate silver behenate dispersion (NPSBD) with a median particle size of 140 nm was obtained (3% solids).

B) Purifying and Concentrating NPSBD

The 3% solids nanoparticulate silver behenate dispersion (12 kg) was loaded into a diafiltration/ultrafiltration apparatus (with an Osmonics model 21-HZ20-S8J permeator membrane cartridge having an effective surface area of 0.34 $m^2$ and a nominal molecular weight cutoff of 50,000). The apparatus was operated so that the pressure going into the permeator was 50 $lb/in^2$ (3.5 $kg/cm^2$) and the pressure downstream from the permeator was 20 $lb/in^2$ (1.4 $kg/cm^2$). The permeate was replaced with deionized water until 24 kg of permeate were removed from the dispersion. At this point the replacement water was turned off and the apparatus was run until the dispersion reached a concentration of 28% solids to provide a nanoparticulate silver behenate dispersion (NPSB).

Preparation of Phthalazine N-Oxide

Phthalazine (0.40 moles) was dissolved in 200 ml of glacial acetic acid. Under nitrogen, 10 ml portions of a 32% solution of peracetic acid in acetic acid were added until 0.44 mole had been added and then the mixture was heated to 80° C. for 1 hour. The resulting reaction mixture was cooled to room temperature and the acetic acid was removed using a rotary evaporator. The solid residue was suspended/dissolved in 500 ml water and treated with 50 ml of 50% sodium hydroxide and extracted 5 times with 500 ml of dichloromethane. The organic extracts were combined, dried over magnesium sulfate, crystallized from dichloromethane-hexane, and vacuum-dried to yield 50.1 g of phthalazine N-oxide (0.34 mole), mp (DSC)=149° C. GC analysis showed the desired product contained less than 0.5% phthalazine.

Example 1

Aqueous-Based Photothermographic Material

A photosensitive thermographic emulsion was prepared by combining, at 40° C., 184 grams of a 15% aqueous solution of gelatin peptizer (cattle bone, alkali treated, deionized gelatin) with 55.3 grams of water and 184.9 grams of an aqueous nanoparticulate silver behenate dispersion prepared as described above. To this mixture were added 1.11 g of phthalazine N-oxide, 4.0 grams of a 25 g/l aqueous solution of AF-1, 1.85 g of a solid particle dispersion of AF-2, 3.89 grams of succinimide, and 5.67 grams of a 50 g/l aqueous solution of sodium iodide. This mixture was combined with 49.4 grams of a solid particle dispersion of developer DEV-1 and was stirred overnight.

A primitive silver iodobromide cubic grain emulsion, 48 nm in edge length and containing 20 g gelatin per mole of silver was melted at 40° C. and was spectrally sensitized at 40° C. by combining 8.29 grams of the emulsion (0.771 kg/mol of Ag) with 3.61 g of a 10% aqueous solution of Surfactant 10G® (Dixie Chemical Company) followed by 5.36 grams of a 3 g/l aqueous solution of D-1 followed by addition of 0.87 grams of a 7 g/l of a methanolic solution of D-2. The resulting mixture was held for 10 minutes and chill set. Prior to coating at 40° C., the silver behenate mixture described above was combined with 13.8 grams of spectrally sensitized emulsion with good stirring. To this mixture were added 5.56 grams of a 100 g/l basic solution of 4-methyl phthalic acid.

The solid particle dispersion of the developer had been prepared by milling a 20% solution of Dev-1 with 0.8% sodium dodecyl sulfate in water. The solid particle dispersion of AF-2 had been prepared by milling a 20% solution of AF-2 with 2.0% of TRITON® X-200 surfactant (Rohm and Haas, Philadelphia Pa.) in water.

A thermally processable photothermographic element was prepared by coating a gelatin-subbed poly(ethylene terephthalate) support, having a thickness of 0.178 mm, with photothermographic emulsion described above, followed by a protective overcoat formulation. These formulations are coated on the support using conventional coating procedures known in the photographic art. The photothermographic emulsion was coated from aqueous solution at a wet coverage of 97.8 g/m$^2$ to form an imaging layer having the dry composition shown in the following TABLE I.

TABLE I

| COMPONENTS | DRY COVERAGE (g/m$^2$) |
|---|---|
| Succinimide | 0.761 |
| 4-Methyl phthalic acid | 0.109 |
| DEV-1 | 1.935 |
| Emulsion (cubic edge 0.048 $\mu$m) silver level | 0.175 |
| Surfactant 10G ® | 0.054 |
| D-1 | 0.00242 |
| D-2 | 0.00073 |
| Silver behenate | 7.652 |
| Gelatin | 5.435 |
| Sodium Iodide | 0.055 |
| AF-1 | 0.0196 |
| AF-2 | 0.0543 |
| Phthalazine N-Oxide | 0.2173 |

The resulting imaging layer was then overcoated with the overcoat formulation shown in the following TABLE II at a wet coverage of 28.7 cc/m$^2$ and a dry coverage as shown in the following TABLE III.

TABLE II

| COMPONENT | GRAMS |
|---|---|
| Distilled Water | 2523.75 grams |
| Dry gelatin peptizer (cattle bone, alkali treated, deionized, oxidized gelatin) | 300 |
| Aerosol OT (5% by weight in distilled water/methanol 5:1) (Aerosol OT is a sodium bis-2-ethylhexyl sulfosuccinate surfactant that is available from the Cyanamid Inc.) | 52.5 |
| Alkanol XC (10% by weight in distilled water, DuPont) | 78.7 |
| Succinimide | 45 |

TABLE III

| COMPONENTS | DRY COVERAGE |
|---|---|
| Gelatin | 2.174 |
| Succinimide | 0.326 |
| Aerosol OT | 0.019 |
| Alkanol XC | 0.057 |

Samples of the resulting photothermographic material were exposed using a 810 nm laser sensitometer and heat processed at 15 seconds at both 118° C. and 122° C. to produce a developed silver image.

Examples 2–3

Aqueous Photothermopraphic Materials With Varying Amounts of Phthalazine N-oxide Two photothermographic materials of the present invention were prepared like that described in Example 1 except solid phthalazine N-oxide was included in an amount of 0.56 g (Example 3) and 1.67 g (Example 4) before the addition of AF-1. This provided dry toner coverage of0.1087 g/m and 0.3261 g/m$^2$, respectively, in the imaging layers.

Comparative Example 1

A photothermographic material was prepared like that described in Example 1 except phthalazine N-oxide was omitted.

Comparative Example 2

Another photothermographic material was prepared like that described in Example 1 except 1.11 g of a 100 g/l aqueous solution phthalazine was added before AF-1 in place of the phthalazine N-oxide. This gave a dry coverage of phthalazine of 0.2174 g/m in the imaging layer.

Example 4

Alternative Photothermopraphic Material

Another photothermographic material of this invention was prepared like that described in Example 1 except succinimide was omitted form the protective overcoat layer.

Comparative Example 3

A photothermographic material was prepared as described in Comparative Example 1 except succinimide was also omitted from the protective overcoat layer.

Example 5

The following TABLES IV and V provide sensitometric results with the noted photothermographic materials exposed to IR laser and heat developed at two temperatures, 118° C. and 122° C. TABLE V shows similar results for blue-light exposed materials (IR blocked) and heat development at 122° C. $D_{min}$ density and $D_{max}$ density were measured using a conventional densitometer. Photographic speed ("Speed") was relative speed measured at 1.0 above $D_{min}$ on a conventional D log E curve. The change in $D_{min}$ was the difference between $D_{min}$ measured after a 30-day natural age incubation vs. "fresh" $D_{min}$.

TABLE IV

Heat processed 15 seconds at 118° C.

| Film | Toner Level (mg/m$^2$) | $D_{min}$ Density | Speed | $D_{max}$ Density |
|---|---|---|---|---|
| Example 1 | 0.1087 | 0.052 | 0.91 | 2.510 |
| Example 2 | 0.2173 | 0.054 | 1.00 | 2.780 |
| Example 3 | 0.3261 | 0.054 | 1.07 | 2.730 |
| Comparative Example 1 | 0 | 0.052 | 0.84 | 1.980 |

TABLE V

Heat processed 15 seconds at 122° C.

| Film | Toner Level (mg/m$^2$) | $D_{min}$ Density | Speed | $D_{max}$ Density | $D_{min}$ Density Change |
|---|---|---|---|---|---|
| Example 1 | 0.1087 | 0.07 | 1.05 | 2.670 | 0.02 |
| Example 2 | 0.2173 | 0.09 | 1.12 | 2.500 | 0.03 |
| Example 3 | 0.3261 | 0.12 | 1.15 | 2.420 | 0.07 |
| Comparative Ex. 1 | 0 | 0.07 | 1.00 | 2.830 | 0.01 |
| Comparative Ex. 2 | 0.2174 | 0.12 | * | 1.060 | 0.50 |
| Example 4 | 0.2173 | 0.05 | 0.91 | 2.400 | |
| Comparative Ex. 3 | 0 | 0.05 | 0.52 | 1.130 | |

*$D_{max}$ too low for speed measurement.

TABLE VI

Heat processed 15 seconds at 122° C.

| Film | Toner Level (mg/m$^2$) | $D_{min}$ Density | Speed | $D_{max}$ Density |
|---|---|---|---|---|
| Example 1 | 0.1087 | 0.08 | 1.10 | 2.620 |
| Example 2 | 0.2173 | 0.09 | 1.20 | 2.490 |
| Example 3 | 0.3261 | 0.11 | 1.25 | 2.400 |
| Comparative Ex. 1 | 0 | 0.07 | 1.00 | 2.760 |
| Comparative Ex. 2 | 0.2174 | 0.12 | 0.94 | 2.750 |
| Example 4 | 0.2173 | 0.05 | 0.95 | 2.470 |
| Comparative Ex. 3 | 0 | 0.05 | 0.63 | 1.130 |

The speed and $D_{max}$ data presented in TABLE IV show the advantage of using phthalazine N-oxide in the photothermographic materials of this invention (Examples 1–3) at a development temperature of 118° C. Both speed and $D_{max}$ were improved with no significant increase in $D_{min}$ relative to Comparative Example 1 that did not contain phthalazine N-oxide.

Comparing the $D_{max}$ of the materials developed 118° C. with that of materials developed at 122° C. (TABLES IV and V), the Example 1–3 materials showed a much improved process temperature stability then Comparative Example 1. The higher speed and $D_{max}$ of Example 4 compared to Comparative Example 2 shows that phthalazine N-oxide improved heat developability at a reduced succinimide (development promoter) level.

A comparison of the $D_{max}$ and speed for blue-light exposed and 810 nm laser exposed Comparative Example 2 (TABLE V and VI) shows that phthalazine has an undesirable effect on the 810 nm performance. It interferes with the infrared spectral sensitivity. TABLE V also shows that Comparative Example 2 exhibited an undesirable $D_{min}$ density increase after 30 days of natural age incubation. The invention materials did not show a significant interaction with the infra-red spectral sensitivity and exhibited significantly improved 30-day natural age incubation stability.

Examples 6–7

Preparation of Spectrally-Sensitized Emulsion

A spectrally-sensitized emulsion was prepared by adding to 12.8 grams of emulsion (0.771 kg/mol Ag iodobromide, 3% 1 cubic emulsion, 48 nm in edge length and containing 20 g/silver mole gelatin) at 40° C. 3.5 g of a 10% solution of Olin 10G surfactant, 1.5 g of water, and 10 g of a 2.5 g/l aqueous solution of D-1 followed by addition of 10 ml of a 1.0 g/l methanolic solution of D-2. This sensitized emulsion was held for 10 minutes.

Preparation of Coating Formulations

A coating formulation was prepared by dissolving 0.109 g of 2H-1,3-benzoxazine-2,4(3H)-dione (BZD) into 39 grams of a 16% aqueous solution of gelatin peptizer (cattle bone, alkali treated, deionized gelatin). At 40° C., were added 40 g of an aqueous nanoparticulate silver behenate dispersion prepared as described above. To this mixture was added 0.5 g AF-2 in the form of a solid particle dispersion, 1.0 grams of a 25 g/l aqueous solution of AF-1. This mixture was combined with 12 g of a 20 weight % solid particle dispersion of developer DEV-1 and the mixture was stirred for 20 min. Then 1.25 g of a 120 g/l basic solution of 4-methyl phthalic acid was added. A 8.4 g portion of the spectrally-sensitized emulsion was then added.

The resulting mixture was divided into three 21 g portions. To two portions was added 4 ml of aqueous solutions of phthalazine N-oxide. Only water was added to the third portion. The three portions were hand coated onto a gelatin-subbed poly(ethylene terephthalate) support at 89 g/m$^2$ wet coverage. The resulting coatings were dried and exposed through a Kodak Wratten 89B infra-red filter and step tablet then heat developed for 15 seconds at 122° C. TABLE VII below shows the results of the sensitometric evaluations.

TABLE VII

| Film | Phthalazine N-oxide Level (mg/m$^2$) | $D_{min}$ Density | $D_{max}$ Density |
|---|---|---|---|
| Example 7 | 0.388 | 0.11 | 0.77 |
| Example 8 | 0.517 | 0.10 | 1.10 |
| Comparative Ex. 4 | 0 | 0.09 | 0.09 |

The Comparative Example 4 film did not produce an image after exposure and development while the materials of this invention provided an image.

The invention has been described in detail with particular reference to certain preferred embodiments thereof, but it will be understood that variations and modifications can be effected within the spirit and scope of the invention.

We claim:

1. A thermally sensitive emulsion comprising:

a) a photosensitive silver halide, b) a non-photosensitive source of reducible silver ions, c) a hydrophilic binder, d) a reducing agent composition for said reducible silver ions, e) a development promoter, and f) phthalazine N-oxide or a derivative thereof.

2. The emulsion of claim 1 wherein said phthalazine N-oxide or a derivative thereof is present in an amount of at least 3.8 mmole per mole of total silver.

3. The emulsion of claim 1 comprising phthalazine N-oxide.

4. The emulsion of claim 1 wherein said hydrophilic binder is polyvinyl alcohol, gelatin, a gelatin derivative, or a hydroxy-substituted cellulosic material.

5. The emulsion of claim 1 wherein said photosensitive silver halide is silver bromide or silver iodobromide, or a mixture thereof.

6. The emulsion of claim 1 further comprising an antifoggant, high contrast agent, or a spectral sensitizing dye.

7. The emulsion of claim 1 wherein said non-photosensitive source of reducible silver ions includes one or more silver carboxylates, one of which is silver behenate.

8. The emulsion of claim 1 wherein said reducible agent composition comprises a hindered phenol reducing agent.

9. The emulsion of claim 1 wherein said development promoter is succinimide, 2H-1,3-benzoxazine-2,4-(3H)-dione, or phthalazinone.

10. The emulsion of claim 1 wherein said phthalazine N-oxide is represented by the following Structure I:

(I)

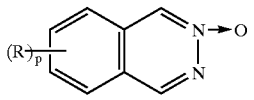

wherein R represents the same or different halo groups, substituted or unsubstituted alkyl groups, substituted or unsubstituted alkoxy groups, substituted or unsubstituted phenoxy groups, nitro groups, cyano groups, carboxy (or salts), or sulfo (or salts) groups, or if two or more of the substituents are attached 1 or 2 carbon atoms distant from each other, they can form an aliphatic, aromatic, or heterocyclic ring with the phthalazine ring shown in Structure I, and p is an integer of 0 to 4.

11. A photothermographic material comprising a support having thereon at least one imaging layer comprising a hydrophilic binder, and having in reactive association:

a) a photosensitive silver halide, b) a non-photosensitive source of reducible silver ions, c) a reducing agent composition for said reducible silver ions, d) a development promoter, and e) phthalazine N-oxide or a derivative thereof.

12. The photothermographic material of claim 11 wherein said reducing agent composition comprises a hindered phenol and said non-photosensitive source of reducible silver ions includes one or more silver carboxylates at least one which is silver behenate.

13. The photothermographic material of claim 11 wherein said non-photosensitive source of reducible silver ions includes one or more silver carboxylates provided in an aqueous nanoparticulate dispersion.

14. The photothermographic material of claim 11 wherein said phthalazine N-oxide is represented by the following Structure I:

(I)

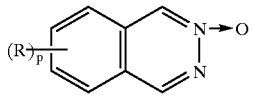

wherein R represents the same or different halo groups, substituted or unsubstituted alkyl groups, substituted or unsubstituted alkoxy groups, substituted or unsubstituted phenoxy groups, nitro groups, cyano groups, carboxy (or salts), or sulfo (or salts) groups, or if two or more of the substituents are attached 1 or 2 carbon atoms distant from each other, they can form an aliphatic, aromatic, or heterocyclic ring with the phthalazine ring shown in Structure I, and p is an integer of 0 to 4.

15. The photothermographic material of claim 11 wherein said development promoter is a cyclic imide, phthalazinone, benzoxazine dione, benzthiazine dione, or quinazoline dione.

16. The photothermographic material of claim 15 wherein said development promoter is succinimide or a compound represented by the following Structure II or III:

(II)

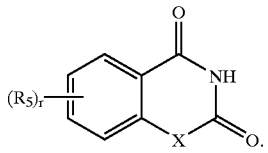

wherein $R_5$ independently represents one or more hydrogen, alkyl groups, cycloalkyl groups, alkoxy groups, alkylthio groups, arylthio groups, hydroxy groups, halogen groups, or $N(R_8R_9)$ groups, or any two of $R_5$ can be taken together to represent the atoms necessary to form a fused aromatic, heteroaromatic, alicyclic, or heterocyclic ring, $R_8$ and $R_9$ each independently represents hydrogen, an alkyl group, aryl group, cycloalkyl group, alkenyl group, or heterocyclic group, or $R_8$ and $R_9$ taken together can represent the atoms necessary to form a substituted or unsubstituted 5- to 7-membered heterocyclic ring, X represents O, S, Se, or $N(R_6)$, wherein $R_6$ represents hydrogen or an alkyl group, aryl group, cycloalkyl group, alkenyl group, or heterocyclic group, and r is 0, 1, or 2, (III)

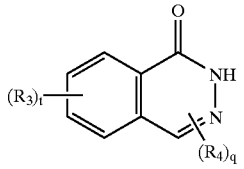

wherein $R_3$ and R4 each independently represent hydrogen, alkyl groups, cycloalkyl groups, alkoxy, groups, alkylthio groups, arylthio groups, hydroxy groups, halogen groups, or $N(R_8R_9)$ groups and defined above for $R_5$, or two of the $R_3$ and $R_4$ groups, taken together, can represent the atoms necessary to form a fused aromatic, heteroaromatic, alicyclic, or heterocyclic ring, and t and q are independently 0, 1, or 2.

17. The photothermographic material of claim 11 wherein said reducing agent composition comprises a hindered phenol reducing agent, and said development promoter is succinimide, 2H-1,3-benzoxazine-2,4-(3H)-dione, or phthalazinone.

18. The photothermographic material of claim 11 further comprising an aqueous-based protective overcoat disposed over said imaging layer, an aqueous-based backside antihalation layer, or both.

19. The photothermographic material of claim 11 further comprising an antifoggant that has a pKa of 8 or less and is represented by the following Structure I:

$$R_1—SO_2—C(R_2)R_{10}—(CO)_m—(L)_n—SG \quad (IV)$$

wherein $R_1$ is an aliphatic or cyclic group, $R_2$ and $R_{10}$ are independently hydrogen or bromine as long as at least one of them is bromine, L is an aliphatic divalent linking group, m and n are independently 0 or 1, and SG is a solubilizing group having a pKa of 8 or less.

20. The photothermographic material of claim 11 that is sensitive to radiation of from about 600 to about 1150 nm.

21. The photothermographic material of claim 11 wherein said hydrophilic binder is polyvinyl alcohol, gelatin, a gelatin derivative, or a hydroxy-substituted cellulosic material.

22. The photothermographic material of claim 11 wherein said hydrophilic binder and components a), b), c), and d) are provided in a single photothermographic emulsion layer.

23. The photothermographic material of claim 11 comprising from about 0.2 to about 5 $g/m^2$ total silver.

24. The photothermographic material of claim 11 wherein said phthalazine N-oxide is present in an amount of from about 0.01 to about 2 $g/m^2$ and said development promoter is present in an amount of from about 3 to about 1300 $mg/m^2$.

25. A method of forming a visible image comprising:

A) imagewise exposing the photothermographic material of claim 11 to electromagnetic radiation at a wavelength greater than 400 nm to form a latent image, B) simultaneously or sequentially, heating said exposed photothermo-graphic material to develop said latent image into a visible image.

26. The method of claim 25 wherein said photothermographic material comprises a transparent support, and said image-forming method further comprising:

C) positioning said exposed and heat-developed photothermographic material having said visible image therein between a source of imaging radiation and an imageable material that is sensitive to said imaging radiation, and D) thereafter exposing said imageable material to said imaging radiation through the visible image in said exposed and heat-developed photo-thermographic material to provide a visible image in said imageable material.

27. A photothermographic material comprising a transparent support having thereon an aqueous-based imaging layer comprising gelatin or a gelatin derivative as binder, an aqueous-based surface protective overcoat over said imaging layer, and an aqueous-based antihalation layer on the backside of said support, and said imaging layer having in reactive association:

a) photosensitive silver bromide, silver iodbbromide, or both, b) a non-photosensitive source of reducible silver ions that comprises one or more silver carboxylates provided as an aqueous nanoparticulate dispersion, at least one of which silver carboxylates is silver behenate, c) a reducing agent composition for said reducible silver ions that includes 2,2'(2-methylpropylidene) bis(4,6-dimethyl-phenol), 2,2'-(3,5,5-trimethylhexylidene)bis(4,6-dimethyl-phenol), or a mixture thereof, d) one or more antifoggants or spectral sensitizing dyes, e) succinimide, 2H-1,3-benzoxazine-2,4-(3H)-dione, or phthalazinone as a development promoter in an amount of from about 6 to about 1300 $mg/m^2$, and f) phthalazine N-oxide present in an amount of from about 4 to about 800 mmole per mole of total silver.

* * * * *